US008863541B2

(12) United States Patent
Swofford et al.

(10) Patent No.: US 8,863,541 B2
(45) Date of Patent: Oct. 21, 2014

(54) AIR DISTRIBUTION SYSTEM FOR TEMPERATURE-CONTROLLED CASE

(75) Inventors: Timothy Dean Swofford, Midlothian, VA (US); Larry C. Howington, Chesterfield, VA (US); Jules G. Choueifati, Chester, VA (US)

(73) Assignee: Hill Phoenix, Inc., Conyers, GA (US)

( * ) Notice: Subject to any disclaimer, the term of this patent is extended or adjusted under 35 U.S.C. 154(b) by 1396 days.

(21) Appl. No.: 12/506,984

(22) Filed: Jul. 21, 2009

(65) Prior Publication Data

US 2010/0313588 A1 Dec. 16, 2010

Related U.S. Application Data

(60) Provisional application No. 61/185,890, filed on Jun. 10, 2009.

(51) Int. Cl.
*A47F 3/04* (2006.01)

(52) U.S. Cl.
CPC ..... *A47F 3/0443* (2013.01)
USPC ..... 62/255; 62/256

(58) Field of Classification Search
CPC .... A47F 3/0447; A47F 3/0443; F25D 23/023
USPC ..... 62/255, 256
See application file for complete search history.

(56) References Cited

U.S. PATENT DOCUMENTS 3,119,241 A 1/1964 Wile
3,125,864 A * 3/1964 Ural ..... 62/256
3,256,799 A 6/1966 Beckwith et al.
3,270,655 A 9/1966 Guirl et al.
3,771,323 A 11/1973 Simons et al.
3,937,033 A 2/1976 Beckwith et al.
4,124,996 A 11/1978 Kennedy et al.
4,269,037 A 5/1981 Karashima (Continued)

FOREIGN PATENT DOCUMENTS

WO WO-2005/058101 A1 6/2005
WO WO-2006/115824 A2 11/2006
WO WO-2008/051226 A1 5/2008

OTHER PUBLICATIONS

U.S. Appl. No. 12/480,510, filed Jun. 8, 2009, Barreto et al.

(Continued)

*Primary Examiner* — Allen Flanigan
*Assistant Examiner* — Filip Zec
(74) *Attorney, Agent, or Firm* — Foley & Lardner LLP

(57) ABSTRACT

A temperature-controlled case is provided including a rear wall spaced apart from an intermediate wall, forming a cavity therebetween. The intermediate wall includes a first set of openings disposed below a second set of openings. A deck may be disposed proximate to the first set and the shelves proximate to the second set of openings. Each shelf may include a shelf base and cover, the cover having openings through which air may be directed. An air distribution system having an air diverting device provides for improved air flow and cooling of products within the case. The air diverting device directs a first portion of an air flow toward the deck and permits a second portion to be directed toward the shelves. The air diverting device may direct the first portion of the air flow through the cavity and towards the deck, or away from the cavity and towards the deck.

19 Claims, 17 Drawing Sheets

(56) References Cited

U.S. PATENT DOCUMENTS

| | | | | |
|---|---|---|---|---|
| 4,299,099 | A | 11/1981 | Myers et al. | |
| 4,514,988 | A | 5/1985 | Ibrahim | |
| 4,592,209 | A * | 6/1986 | Casanova et al. | 62/255 |
| 4,750,335 | A | 6/1988 | Wallace et al. | |
| 4,765,150 | A | 8/1988 | Persem | |
| 4,938,034 | A | 7/1990 | Rosanio et al. | |
| RE33,620 | E | 6/1991 | Persem | |
| 5,048,303 | A | 9/1991 | Campbell et al. | |
| 5,228,581 | A | 7/1993 | Palladino et al. | |
| 5,357,767 | A | 10/1994 | Roberts | |
| 5,475,987 | A | 12/1995 | McGovern | |
| 5,475,988 | A | 12/1995 | McGovern | |
| 5,606,863 | A | 3/1997 | Kicklighter et al. | |
| 5,644,831 | A | 7/1997 | Federico | |
| 5,675,983 | A | 10/1997 | Ibrahim | |
| 5,755,108 | A | 5/1998 | Ibrahim et al. | |
| 5,924,297 | A | 7/1999 | Wolff et al. | |
| 6,094,925 | A | 8/2000 | Arshansky et al. | |
| 6,094,931 | A * | 8/2000 | Jeong | 62/407 |
| 6,151,904 | A | 11/2000 | Jin | |
| 6,170,270 | B1 | 1/2001 | Arshansky et al. | |
| 6,185,951 | B1 | 2/2001 | Lane et al. | |
| 6,360,548 | B1 | 3/2002 | Navarro | |
| 6,381,976 | B1 | 5/2002 | Kempiak et al. | |
| 6,405,548 | B1 | 6/2002 | Hollenbeck | |
| 6,431,060 | B1 | 8/2002 | Gutheim | |
| 6,519,962 | B1 | 2/2003 | Schuetter | |
| 6,539,741 | B2 | 4/2003 | Navarro | |
| 6,694,757 | B1 | 2/2004 | Backman | |
| 6,708,511 | B2 | 3/2004 | Martin | |
| 6,722,149 | B1 | 4/2004 | Saroka et al. | |
| 6,742,344 | B2 | 6/2004 | Vormedal | |
| 6,745,344 | B1 | 6/2004 | Joshi et al. | |
| 6,745,588 | B2 | 6/2004 | Kahler | |
| 6,827,463 | B2 | 12/2004 | Chuang et al. | |
| 6,851,271 | B2 | 2/2005 | Upton et al. | |
| 6,883,343 | B2 | 4/2005 | Lane et al. | |
| 6,889,514 | B2 | 5/2005 | Lane et al. | |
| 6,889,518 | B2 | 5/2005 | Lane et al. | |
| 6,912,864 | B2 | 7/2005 | Roche et al. | |
| 6,915,652 | B2 | 7/2005 | Lane et al. | |
| 6,955,061 | B2 | 10/2005 | Chiang et al. | |
| 6,959,560 | B2 | 11/2005 | Weikel et al. | |
| 6,981,385 | B2 | 1/2006 | Arshansky et al. | |
| 6,993,925 | B2 | 2/2006 | Duffy | |
| 7,010,924 | B2 | 3/2006 | Kempiak | |
| 7,036,947 | B2 | 5/2006 | Chuang et al. | |
| 7,065,979 | B2 | 6/2006 | Arshansky et al. | |
| 7,121,104 | B2 | 10/2006 | Howington et al. | |
| 7,159,413 | B2 | 1/2007 | Dail | |
| 7,216,500 | B2 | 5/2007 | Schwichtenberg et al. | |
| 7,275,376 | B2 | 10/2007 | Swofford et al. | |
| 7,357,000 | B2 | 4/2008 | Schwichtenberg et al. | |
| 7,497,770 | B2 | 3/2009 | Grassmuck et al. | |
| 2001/0042383 | A1 | 11/2001 | Chiang et al. | |
| 2001/0042384 | A1 | 11/2001 | Chiang et al. | |
| 2002/0162346 | A1 | 11/2002 | Chiang et al. | |
| 2002/0184904 | A1 | 12/2002 | Wellman | |
| 2003/0159451 | A1 | 8/2003 | Nash, Jr. | |
| 2004/0055321 | A1 | 3/2004 | Kempiak | |
| 2004/0244396 | A1 | 12/2004 | Lane et al. | |
| 2005/0039483 | A1 | 2/2005 | Yun et al. | |
| 2005/0126196 | A1 | 6/2005 | Grassmuck et al. | |
| 2005/0132744 | A1 | 6/2005 | Rohrer et al. | |
| 2005/0138943 | A1 | 6/2005 | Alahyari et al. | |
| 2005/0144966 | A1 | 7/2005 | Upton et al. | |
| 2005/0150241 | A1 | 7/2005 | Upton et al. | |
| 2005/0193755 | A1 | 9/2005 | Duffy | |
| 2006/0042288 | A1 | 3/2006 | Downs | |
| 2006/0242980 | A1 | 11/2006 | Duffy et al. | |
| 2007/0006604 | A1 | 1/2007 | Behr | |
| 2007/0289323 | A1 | 12/2007 | Swofford et al. | |
| 2008/0271473 | A1 | 11/2008 | Fung et al. | |
| 2008/0282719 | A1 | 11/2008 | Fung | |
| 2009/0044553 | A1 | 2/2009 | Tilley | |
| 2009/0084125 | A1 | 4/2009 | Fung | |
| 2009/0205351 | A1 | 8/2009 | Fung | |
| 2009/0215381 | A1 | 8/2009 | Swofford | |
| 2009/0223237 | A1 | 9/2009 | Grassmuck et al. | |
| 2010/0058789 | A1 | 3/2010 | Barreto et al. | |
| 2010/0212343 | A1 | 8/2010 | Swofford et al. | |

OTHER PUBLICATIONS

PCT International Search Report relating to International Application No. PCT/US05/44177, date of mailing of the International Search Report, Apr. 7, 2006, 1 page.

PCT Written Opinion of the International Search Authority relating to International Application No. PCT/US05/44177, date of completion of this opinion, Mar. 20, 2006, 3 pages.

* cited by examiner

AIR DISTRIBUTION SYSTEM FOR TEMPERATURE-CONTROLLED CASE

CROSS REFERENCE TO RELATED APPLICATIONS

This application claims the benefit of priority under 35 U.S.C. §119(e) of U.S. Provisional Patent Application No. 61/185,890, having a filing date of Jun. 10, 2009, titled "Air Distribution System for Temperature-Controlled Case," the complete disclosure of which is hereby incorporated by reference.

BACKGROUND

It is well known to provide a temperature-controlled display case such as a refrigerator, freezer, refrigerated merchandiser, refrigerated display case, etc., that may be used in commercial, institutional, and residential applications for storing or displaying refrigerated or frozen objects. For example, it is known to provide refrigerated display cases or merchandisers having an air circulation or distribution system for distributing air chilled by a cooling element throughout a display space within the case or merchandiser to maintain products at a desired temperature. However, such known air distribution systems in refrigerated display cases and merchandisers tend to result in uneven air distribution and varying temperatures for the products stored within the case. A temperature-controlled case having an improved air distribution system is provided.

SUMMARY

According to one embodiment a temperature-controlled case comprises a rear wall, a front wall, an air flow device, and an air outlet disposed at least partially between the rear wall and the front wall. The air flow device is configured to provide an air flow discharged through the air outlet. An intermediate wall is spaced apart from the rear wall to define a cavity. The intermediate wall includes a first plurality of openings and second a plurality of openings disposed substantially above the first plurality of openings. The temperature-controlled case further comprises at least one air diverting device. The air diverting device is configured to receive and direct a first portion of the air flow through the first plurality of openings and to permit a second portion of the air flow to be directed through the second plurality of openings.

According to another embodiment, a temperature-controlled case comprises a rear wall, a front wall, a deck having a front portion and a rear portion, and an air flow device configured to provide an air flow. An intermediate wall is spaced apart from the rear wall to define a cavity. At least one shelf includes a front portion and a rear portion. The rear portion of the shelf is disposed adjacent to the intermediate wall. At least one air diverting device is configured to receive and direct a first portion of the air flow through the cavity and toward the deck and to permit a second portion of the air flow to be received in the cavity and be directed toward the shelf.

According to another embodiment, a temperature-controlled case comprises a front wall, a rear wall, and a deck. The deck extends at least partially between the front wall and the rear wall. An air flow device is disposed beneath the deck and is configured to provide an air flow. An intermediate wall is spaced apart from the rear wall to define a cavity. The intermediate wall includes a plurality of openings. At least one shelf includes a front portion and a rear portion. The rear portion of the shelf is disposed adjacent to the intermediate wall. At least one air diverting device is configured to receive and direct a first portion of the air flow away from the cavity and toward the deck and configured to permit a second portion to be received in the cavity and directed toward the shelf.

According to another embodiment, a temperature-controlled case comprises a front wall, a rear wall, and a deck. The deck extends at least partially between the front wall and the rear wall. An air flow device is disposed beneath the deck and is configured to provide an air flow. An intermediate wall is spaced apart from the rear wall to define a cavity. The intermediate wall includes a plurality of openings. A plurality of shelves each include a front portion and a rear portion. The rear portion of each shelf is disposed adjacent to the intermediate wall. At least one of the plurality of shelves includes a shelf base, a shelf cover, and a space defined therebetween. The shelf cover includes a plurality of openings at the front portion of the shelf. The air flow is directed in a first flow path toward the rear portion of the at least one shelf and directed in a second flow path through the space toward the openings in the front portion of the at least one shelf.

DETAILED DESCRIPTION

Figure 8A:
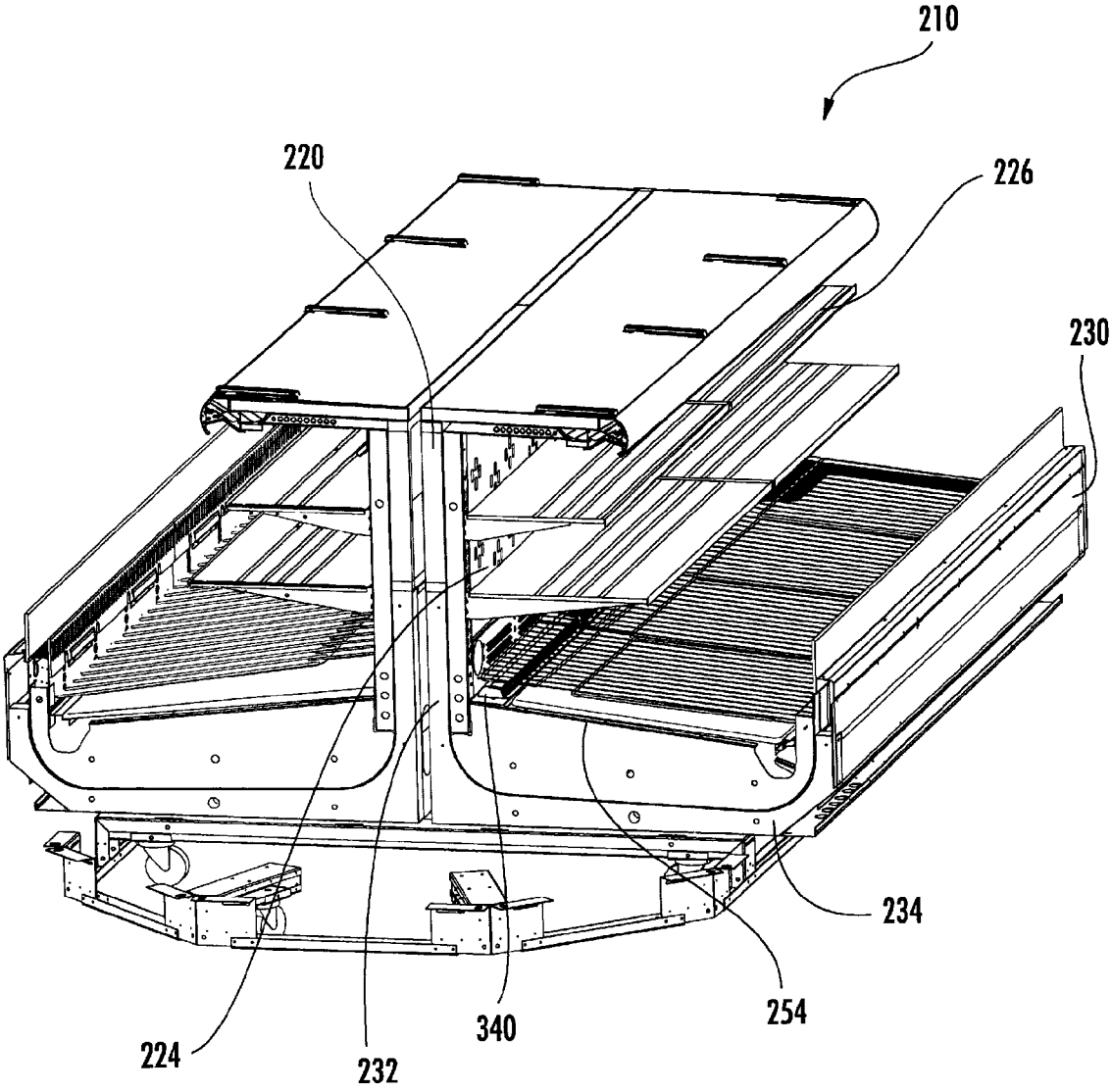
FIG. 8A is a front perspective view of a temperature-controlled case according to a second exemplary embodiment.

Referring to the FIGURES, various embodiments of a temperature-controlled case shown as a refrigerated case 10 are disclosed. According to the embodiments shown, refrigerated case 10 is a "straight" portion of an island-type case. Refrigerated case 10 is further shown as a front-loading, open-front type case (e.g., "reach-in," "self-service," etc.). Accordingly, refrigerated case 10 includes a front 12 that is open and a rear 14. Refrigerated case 10 is configured to be coupled or disposed proximate to the back of another straight portion of an island-type case at rear 14 (see, e.g., FIG. 8A illustrating two refrigerated cases 10 disposed back-to-back). Alternatively, rear 14 may be aligned proximate a wall in the space in which refrigerated case 10 is located. Refrigerated case 10 may be further configured to be coupled to an "end" portion of an island-type case at one or both of its sides, first side 16 and second side 18. While the temperature-controlled case is shown as a refrigerated case, the temperature-controlled case may also be a heated case. Further, concepts disclosed herein may be applied to any of a variety of temperature-controlled cases (e.g., an end portion of an island-type case, a rear-loading case, etc.).

Figure 1A:
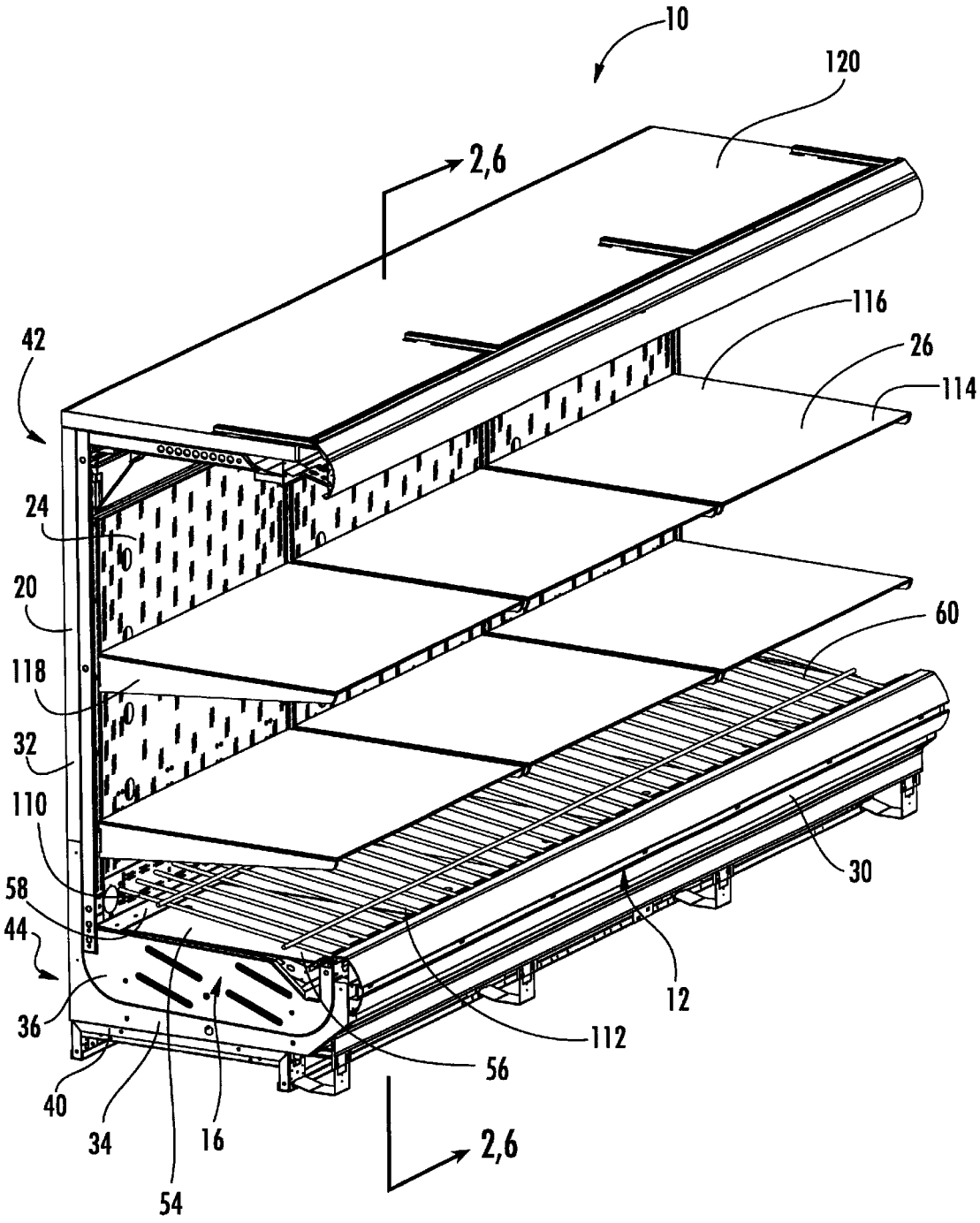
FIG. 1A is a front perspective view of a temperature-controlled case according to a first exemplary embodiment.
Figure 1B:
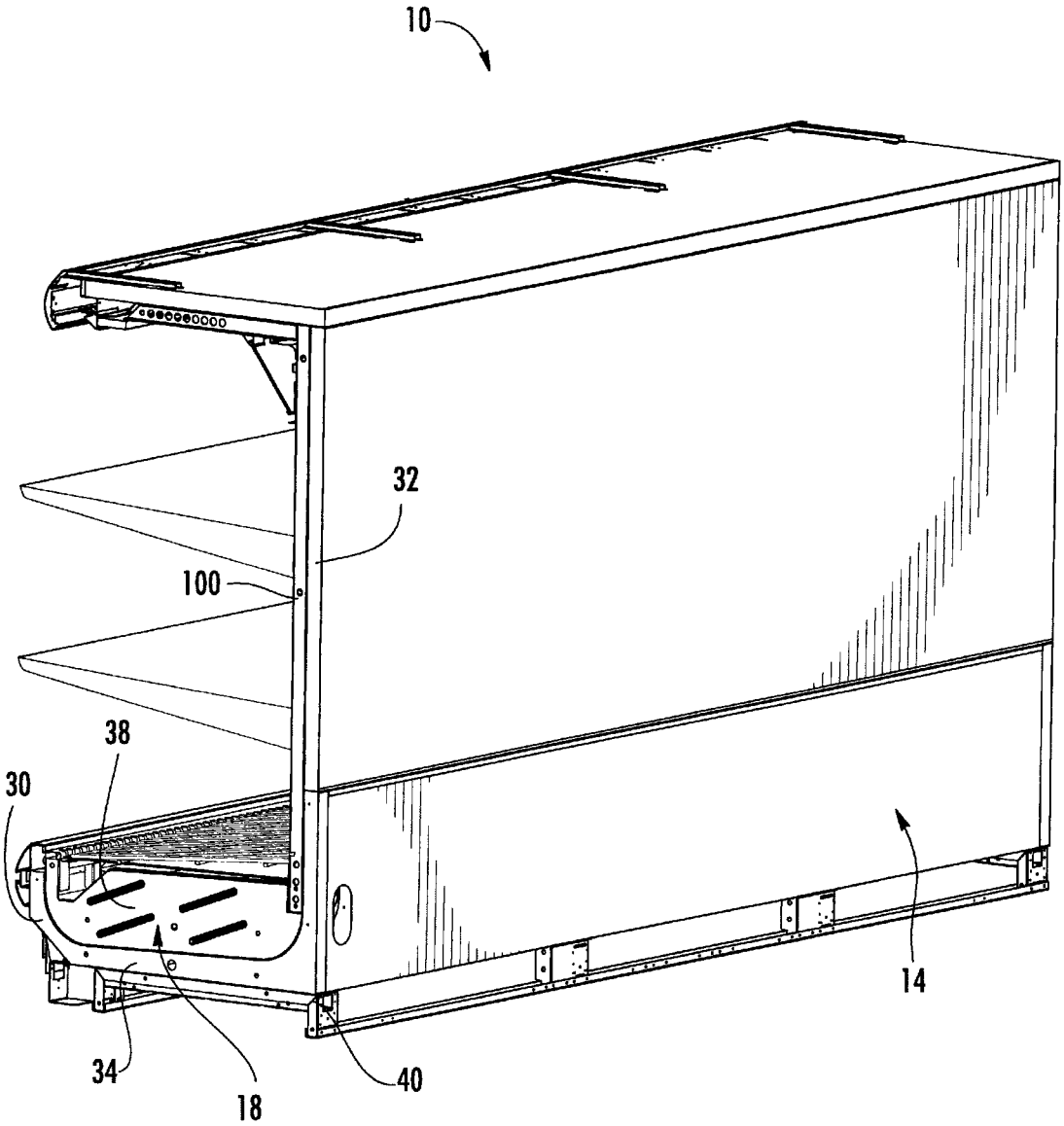
FIG. 1B is a rear perspective view of the exemplary embodiment of a temperature-controlled case of FIG. 1A.
Figure 2:
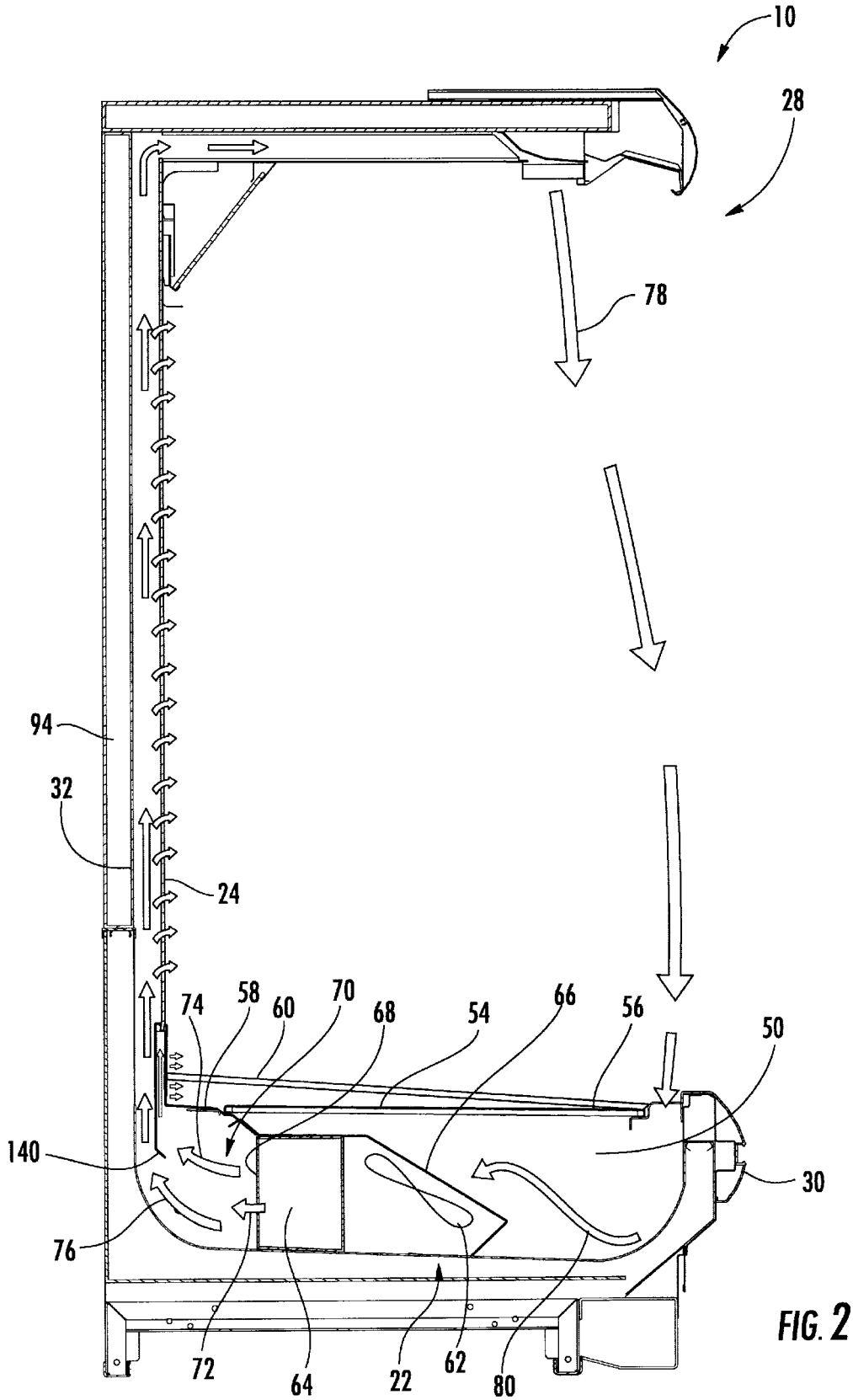
FIG. 2 is a side plan, cross-sectional view of the exemplary embodiment of a temperature-controlled case of FIG. 1A along line 2-2, illustrating the air flow.

Referring to FIGS. 1A and 1B, refrigerated case 10 is shown according to an exemplary embodiment including a frame 20, a cooling system 22 (see, e.g., FIG. 2 illustrating cooling system 22), an intermediate wall 24, a plurality of shelves 26, and an air distribution system 28 (see, e.g., FIG. 2 illustrating air distribution system 28). Refrigerated case 10 displays and/or stores products (e.g., food products, etc.). Refrigerated case 10 is configured to maintain products displayed and/or stored therein at a constant temperature. Air distribution system 28 provides for enhanced air flow and cooling within refrigerated case 10. Further, air distribution system 28 provides for a more balanced cooling profile to maintain products at a more uniform temperature (e.g., products located at various locations within the temperature-controlled case are maintained at substantially the same temperature).

Frame 20 includes a front wall 30, rear wall 32, a bottom wall 34 extending substantially between front wall 30 and rear wall 32, a first side wall 36, and a second side wall 38 according to an exemplary embodiment. Frame 20 provides stability and support for refrigerated case 10 and in part defines the product display space within refrigerated case 10. Bottom wall 34 is generally disposed on or near the ground or floor of a room or space in which refrigerated case 10 is located (e.g., a grocery store, a convenience store, a personal residence, etc.). A support structure 40 may be disposed at least partially below bottom wall 34 to raise frame 20 a distance above the ground. Rear wall 32 of frame 20 substantially corresponds to rear 14 of refrigerated case 10 and may be coupled to another temperature-controlled case (e.g., another straight portion of an island-type case, etc.) to form a larger case (e.g., an island-type case). Rear wall 32 includes a top 42 and a bottom 44. Rear wall 32 is shown extending substantially vertically to a height greater than the height to which front wall 30 extends substantially vertically. Rear wall 32 is further shown substantially opposite front wall 30. First side wall 36 is shown substantially opposite second side wall 38. First side wall 36 and second side wall 38 in part define a cavity 50 (see, e.g., FIG. 2 illustrating cavity 50).

Referring further to FIGS. 1A and 1B, frame 20 further includes a deck 54 configured to provide a product support surface according to an exemplary embodiment. Deck 54 is shown disposed substantially above and spaced a distance from bottom wall 34 of frame 20, at least partially defining cavity 50. Deck 54 is further shown extending substantially horizontally and at least partially between intermediate wall 24 and front wall 30. Deck 54 includes a front portion 56 proximate front wall 30 and a rear portion 58 proximate intermediate wall 24. A grate 60 may be disposed above deck 54 to support products proximate deck 54. Grate 60 (e.g., rack, grill, etc.) is shown spaced apart a distance from deck 54 and configured to allow air pass therethrough, such that air directed toward or along deck 54 will cool products supported on grate 60. In some embodiments, no grate is present.

Referring to FIG. 2, cooling system 22 is shown disposed beneath deck 54 at least partially between rear wall 32 and front wall 30 and within cavity 50 according to an exemplary embodiment. Cooling system 22 includes an air flow device shown as fans 62, a cooling element shown as a cooling coil 64, a control system, an air inlet 66, and an air outlet 68. Cooling system 22 is configured to cool or chill products displayed in refrigerated case 10 and maintain those products a desired temperature. Cooling system 22 generates an air flow 70 that is chilled and distributed throughout refrigerated case 10. Cooling system 22 circulates a coolant through cooling coil 64. The control system regulates a flow of coolant in response to the temperature measured within refrigerated case 10. Fans 62 draw air into cooling system 22 and direct the air through air inlet 66 and through cooling coil 64. The air passing through cooling coil 64 is chilled or cooled before being discharged from cooling system 22 through air outlet 68 as air flow 70. Generally, the number, power, and/or size of the air flow device is selected to achieve a desired air flow. For example, in one embodiment, a single fan may be provided, while, in another embodiment, multiple fans may be provided.

Referring further to FIG. 2, air flow 70 is shown according to an exemplary embodiment including a discharge air flow portion 72. Discharge air flow portion 72 has at least a first portion 74 and a second portion 76. Air flow 70 is further shown including an air curtain 78 and a return air flow portion 80. Air flow 70 is distributed throughout refrigerated case 10 by air distribution system 28.

Figure 3:
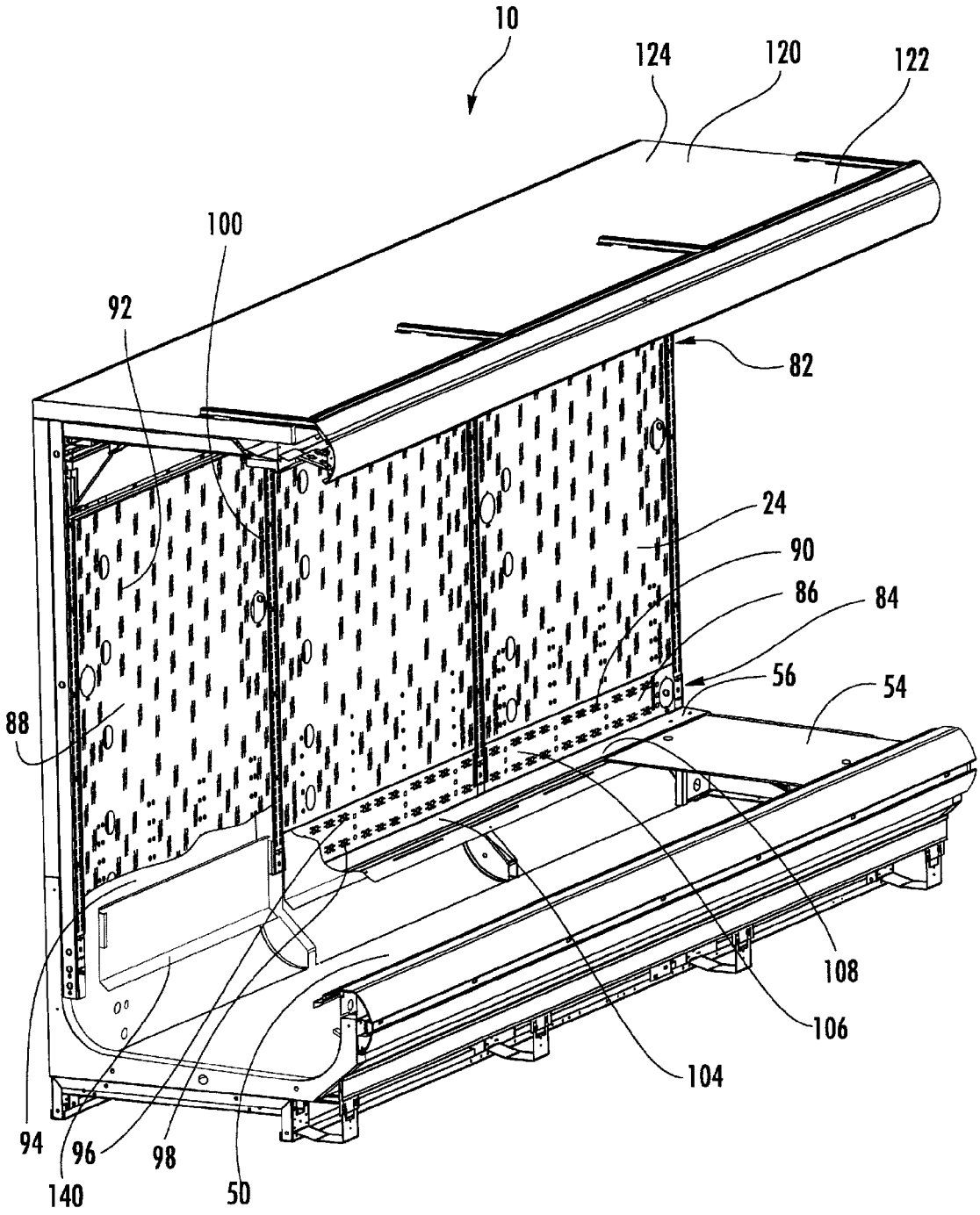
FIG. 3 is a perspective view of the exemplary embodiment of a temperature-controlled case of FIG. 1A.

Referring to FIG. 3, intermediate wall 24 is shown substantially vertical and including a top 82, a bottom 84, and a lower portion 86 substantially below an upper portion 88 according to an exemplary embodiment. Lower portion 86 of intermediate wall 24 includes a first set of openings 90 and upper portion 88 of intermediate wall includes a second set of openings 92. Intermediate wall 24 is configured to distribute (e.g., diffuse, disseminate, direct, deliver, disperse, etc.) air from air flow 70 to the product storage area of refrigerated case 10. Referring back to FIG. 2, intermediate wall 24 is located at least partially between rear wall 32 and front wall 30 of frame 20 and is spaced a distance from rear wall 32, defining a cavity 94 therebetween. Cavity 94 (e.g., gap, hollow space, opening, void, etc.) is shown substantially vertical and configured to receive one or more portions of air flow 70, e.g., first portion 74 and/or second portion 76. Bottom 84 of intermediate wall 24 is spaced a distance from bottom wall 34 of frame 20, providing a space through which air flow 70 may enter into cavity 94. Openings 90 (e.g., holes, slots, apertures, outlets, etc.) of lower portion 86 and openings 92 (e.g., holes, slots, apertures, outlets, etc.) of upper portion 88 provide an exit for air flow 70 from cavity 94. Sub-portions of first portion 74 and second portion 76 of air flow 70 flow through openings 90, 92 in intermediate wall 24 and into the product storage space.

Referring further to FIG. 3, openings 90 in lower portion 86 of intermediate wall 24 are shown in a first pattern including a first row 96 of openings 90 disposed generally above a second row 98 of openings 90. Openings 92 in upper portion 88 form a second pattern, shown different from the first pattern of lower portion 86. In one embodiment, the first pattern and the second pattern are the same. In another embodiment, openings 90 and/or openings 92 may be arranged randomly, having substantially no pattern. Generally, the openings in the intermediate wall may be sized, shaped, and/or arranged in any manner to achieve a desired distribution of the air flow and/or air flow velocity. In some embodiments, openings 90 and/or openings 92 may progressively increase in size and/or quantity from bottom 84 to top 82 of intermediate wall 24. The cavity between the rear wall and the intermediate wall may also be sized and/or shaped to maintain a desired velocity of air flow 70 therethrough and to achieve a desired distribution of air flow 70 through openings 90, 92 in intermediate wall 24.

Figure 4:
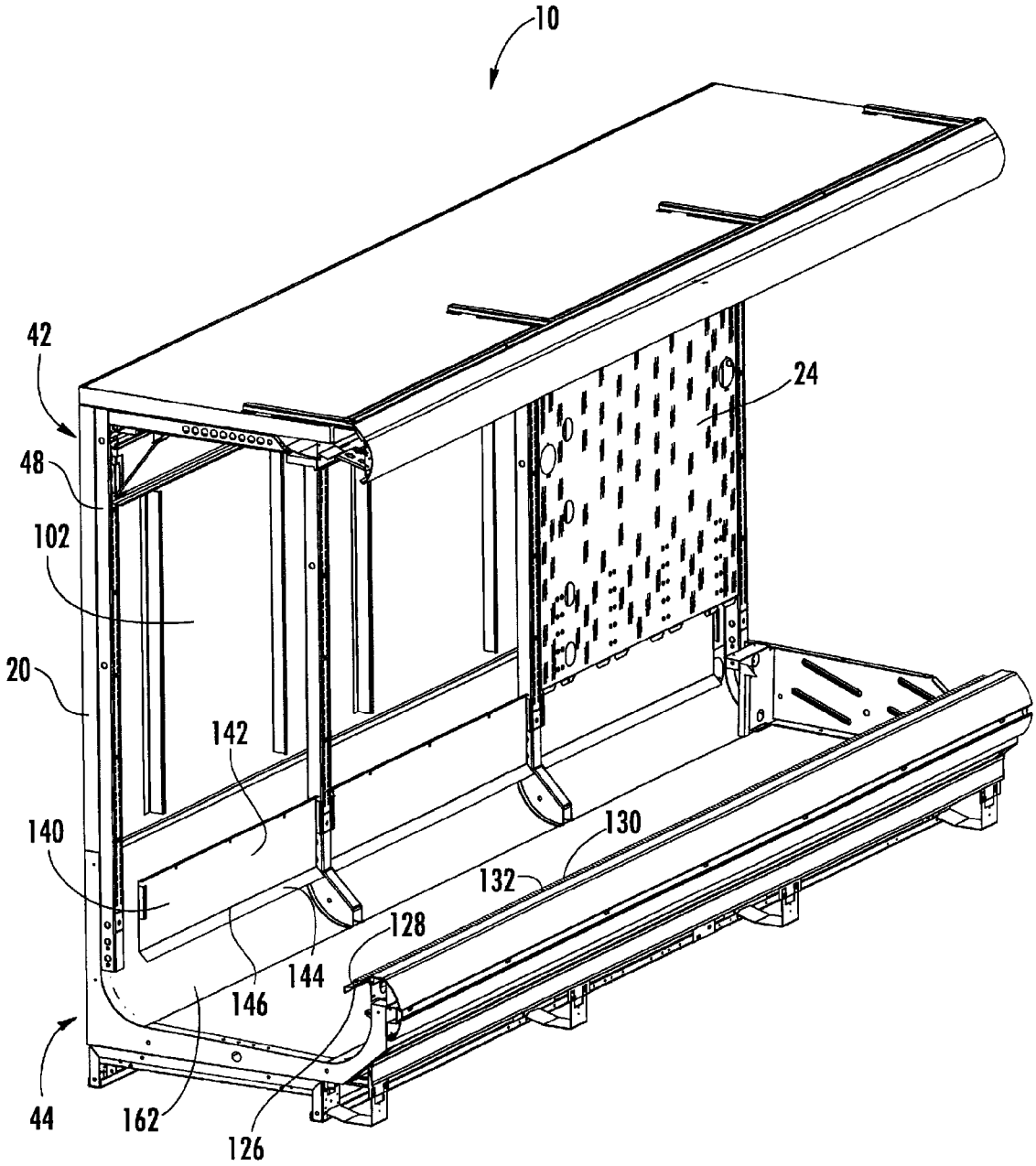
FIG. 4 is a perspective view of the exemplary embodiment of a temperature-controlled case of FIG. 1A.

Referring to FIG. 4, frame 20 is shown further including a plurality of support members shown as frame members 100 according to an exemplary embodiment. Frame members 100 are configured to strengthen and/or stiffen frame 20 and provide support for intermediate wall 24 relative to frame 20. Frame members 100 are further configured to act as brackets providing for shelves 26 to be coupled or mounted thereto. Frame members 100 are shown substantially vertical and spaced apart between first side 16 and second side 18 of refrigerated case 10 generally along the length of rear wall 32. Frame members 100 are shown including a plurality slots or other receiving features or structures for coupling a mounting shelves 26 thereto. Frame members 100 are further shown including a plurality of features or structures for coupling lower portion 86 and upper portion 88 of intermediate wall 24 thereto (e.g., holes configured to receive fasteners). In one embodiment, the frame members are integral with the rear wall of the frame. In another embodiment, the frame members are coupled to the rear wall of the frame. In other embodiments, the frame members may be configured in any manner suitable to strengthen and/or stiffen the frame and provide support for the intermediate wall relative to the frame. In still other embodiments, the frame members may be configured in any manner suitable to support the shelves.

Referring further to FIG. 4, rear wall 32 is shown divided into a plurality of segments 102 defined by frame members 100 according to an exemplary embodiment. Upper portion 88 of intermediate wall 24 is also shown segmented to correspond to segments 102 of rear wall 32. The segments of upper portion 88 of intermediate wall 24 are coupled substantially between frame members 100. Lower portion 86 of intermediate wall 24 is shown substantially continuous, extending generally along the length rear wall 32 of frame 20 and in front of frame members 100. Cavity 94 and shelves 26 may also be segmented or partially segmented to correspond to segments 102 of rear wall 32 (see, e.g., FIG. 1A illustrating the shelves as segmented). According to other embodiments, both the upper portion and the lower portion of the intermediate wall are continuous, both the upper portion and the lower portion are segmented, or the upper portion is continuous and the lower portion is segmented. According to other embodiments, the rear wall is not segmented.

According to one embodiment, an elongated member shown as L-shaped bracket 104 may be provided. Referring back to FIG. 3, L-shaped bracket 104 is shown including a first portion 106 that is substantially vertical and a second portion 108 that is substantially horizontal according to an exemplary embodiment. First portion 106 is shown defining lower portion 86 of intermediate wall 24. Second portion 108 is shown in part defining deck 54. In other embodiments, the first portion and the second portion of the L-shaped bracket may be two separate components. In other embodiments, the first portion of the L-shaped bracket may be integral with the upper portion of the intermediate wall. In other embodiments, the deck may be a single integral surface (e.g., extending between the intermediate wall and the front wall). In another embodiment, the intermediate wall and the deck may be a single integrated piece. In still another embodiment, the intermediate wall, the deck, and the rear wall of the frame may be integral.

Referring further to FIG. 3, rear portion 56 of deck 54 is shown disposed substantially adjacent to lower portion 86 of intermediate wall 24 proximate to openings 90 according to an exemplary embodiment. Deck 54 extends at least partially between intermediate wall 24 and front wall 30. First portion 74 of air flow 70 flows through openings 90 of lower portion 86 of intermediate wall 24 and is directed toward deck 54 to cool products supported thereon or thereabove. Openings 90 are shown above deck 54. According to other embodiments, the deck may be otherwise disposed relative to the intermediate wall and the openings therein.

Figure 7:
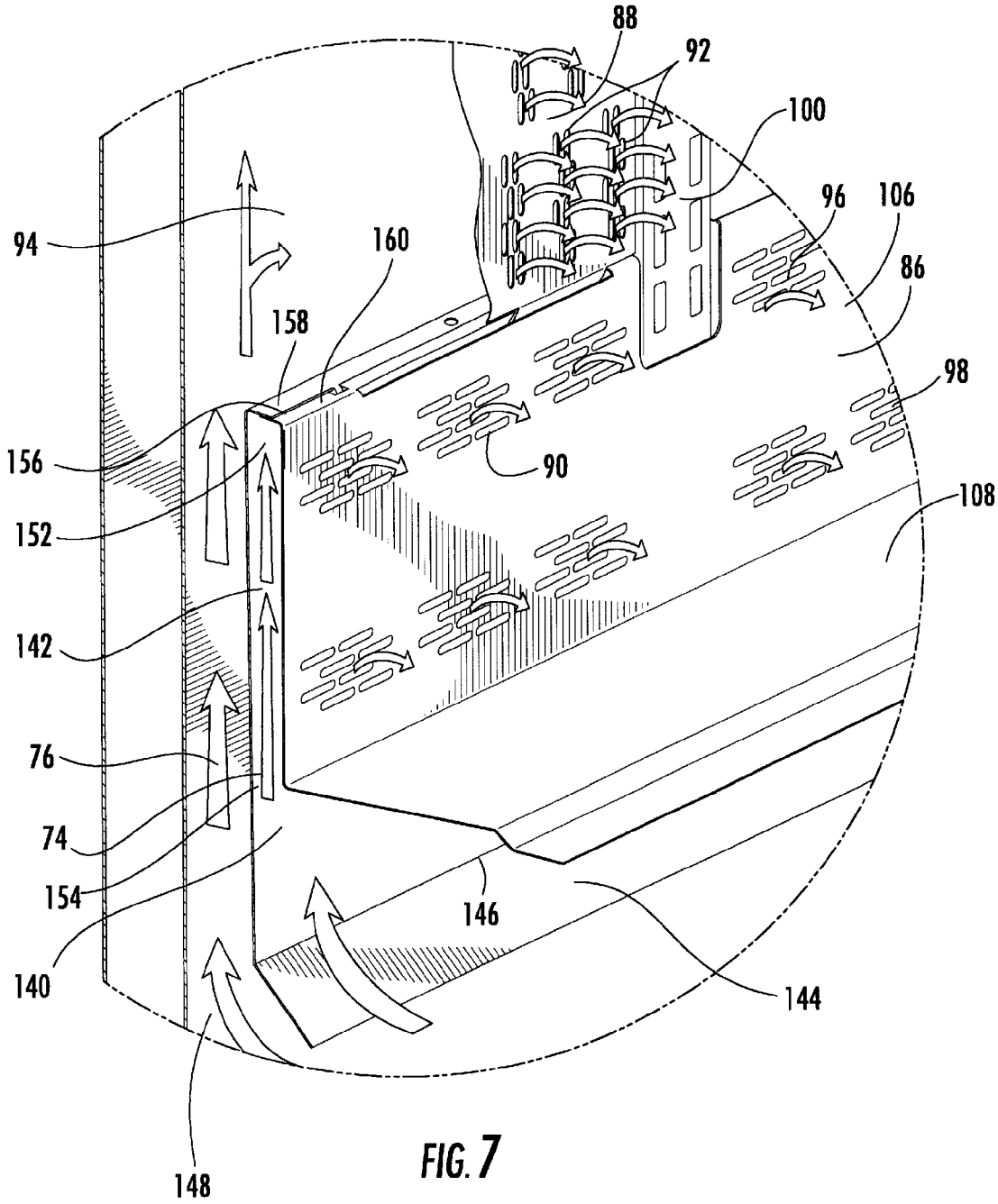
FIG. 7 is a detailed view of FIG. 6 taken along the line 7-7.

Referring back to FIG. 1A, grate 60 is shown disposed above deck 54 to provide for enhanced cooling of products displayed proximate deck 54 according to an exemplary embodiment. Grate 60 includes a grate rear 110 and a grate front 112. Grate rear 110 is shown disposed substantially adjacent to lower portion 86 of intermediate wall 24 such that first row 96 of openings 90 is generally thereabove and second row 98 of openings 90 is generally therebelow. As first portion 74 of air flow 70 is discharged through openings 90 in lower portion 86, sub-portions of first portion 74 of air flow 70 are discharged through first row 96 and through second row 98. Sub-portions of first portion 74 of air flow 70 discharged through first row 96 of openings 90 are directed toward deck 54 generally above grate 60 (see, e.g., FIG. 7 illustrating air being discharged through the first row of openings in the lower portion of the intermediate wall). Sub-portions of first portion 74 of air flow 70 discharged through second row 98 of openings 90 are directed toward deck 54 generally below grate 60 (see, e.g., FIG. 7 illustrating air being discharged through the second row of the openings in the lower portion of the intermediate wall). Sub-portions of first portion 74 of air flow 70 being discharged through first row 96 of openings 90 are directed primarily at products supported at grate rear 110, while sub-portions of first portion 74 of air flow 70 discharged through second row 98 of openings are directed primarily at products supported at grate front 112. Products supported on grate 60 typically cause the velocity of the sub-portions of first portion 74 of air flow 70 exiting above grate 60 to decrease more quickly than the velocity of the sub-portions of first portion 74 of air flow 70 exiting below grate 60. Accordingly, the sub-portions of first portion 74 of air flow 70 flowing through second row 98 are more likely to reach the products supported at grate front 112 (or to reach the product supported at the grate front with greater velocity) than the sub-portions of first portion 74 of air flow 70 exiting above grate 60, providing for enhanced cooling of products supported on grate 60. While grate 60 is shown extending over approximately the entire deck, in other embodiments, the grate may extend over only a portion of the deck. According to still other embodiments, the grate rear may be disposed adjacent to the lower portion of the intermediate wall at locations other than between the first row and the second row of openings. According to still other embodiments, the grate may be disposed adjacent to the intermediate wall at any location.

Referring further to FIG. 1A, shelves 26 of refrigerated case 10 are shown each having a front portion 114 and a rear portion 116 according to an exemplary embodiment. Each shelf 26 is configured to support products displayed within refrigerated case 10. Any of a variety of products may be supported on shelves 26, where the products are cooled and accessible. Rear portion 116 of each shelf 26 is shown disposed adjacent to upper portion 88 of intermediate wall 24 proximate to openings 92. Products supported on shelves 26 are cooled by sub-portions of second portion 76 of air flow 70, that are directed through openings 92 of upper portion 88 toward shelves 26 to cool the products supported thereon. Although, shelves 26 are shown cantilevered and supported by a plurality of shelf brackets 118 mounted to frame members 100, the shelves may be supported in any manner such that the rear portion of each shelf is disposed adjacent or proximate to the intermediate wall. According to other embodiments, the shelves may be otherwise positioned relative to any supporting wall.

Referring back to FIG. 3, a canopy 120 is shown at least partially defining the top of the product storage space according to an exemplary embodiment. Canopy 120 includes a canopy front 122 and a canopy rear 124. Canopy 120 is configured to receive air flow 70 exiting the top of cavity 94. Canopy 120 is further configured to discharge and redirect the remaining portion of air flow 70 toward front wall 30. Canopy 120 is shown extending from proximate rear wall 32 substantially over cavity 50. The air is generally directed downward from canopy front 122 toward front wall 30 of frame 20 (e.g., towards the ground/floor) to establish air curtain 78. Air curtain 78 is configured to help maintain the temperature of the products in refrigerated case 10. Referring back to FIG. 2, air curtain 78 is shown flowing generally downwardly over front 12 of refrigerated case 10. Air curtain 78 is received in an air return 126 as it approaches front wall 30, providing a boundary or separation between the interior or product space of refrigerated case 10 and the warmer ambient environment external to the case.

Referring back to FIG. 4, air return 126 is shown extending substantially along front wall 30, at least partially within cavity 50. Air return 126 is configured to receive and recirculate at least part of air flow 70 throughout refrigerated case 10. Air return 126 includes a body 128 and a plurality of openings shown as slots 130. Slots 130 are generally spaced apart about a top portion 132 of air return 126. Fans 62 draw air curtain 78 in through slots 130 and through body 128 of air return 126. Fans 62 then direct return air flow portion 80 from air return 126 through cooling coil 64 of cooling system 22 to be cooled and recirculated.

Referring to FIGS. 2 and 4, air distribution system 28 includes a plurality of air diverting devices shown as scoops 140 according to a first exemplary embodiment. Scoops 140 are configured to direct first portion 74 of air flow 70 toward deck 54 and permit second portion 76 of air flow 70 to be received in cavity 94 and directed toward shelves 26. Air distribution system 28 is configured to provide enhanced air flow throughout refrigerated case 10. Air distribution system 28 is further configured to provide for balanced cooling throughout refrigerated case 10 to help maintain products displayed therein at a substantially uniform temperature (e.g., preventing temperature disparities between products on or proximate the deck and products on the shelves, etc.).

Figure 5:
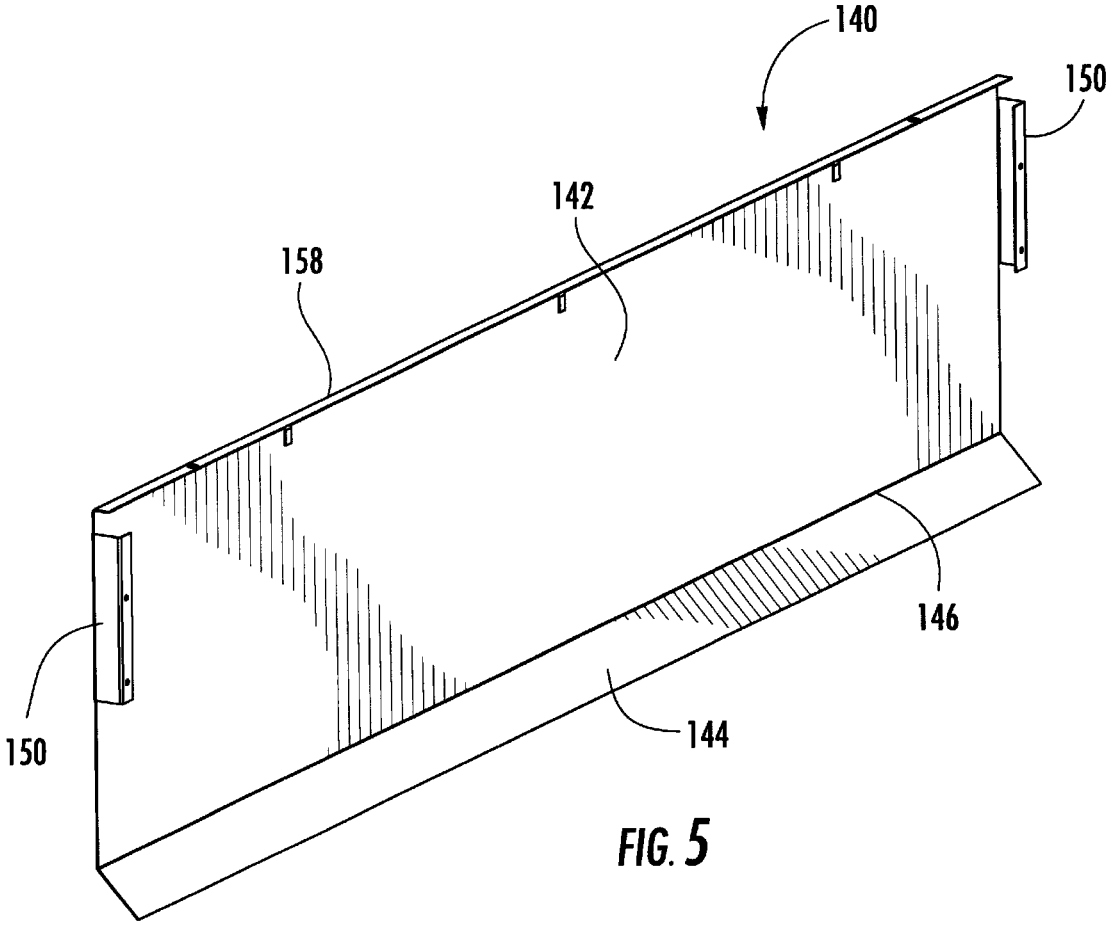
FIG. 5 is a perspective view of a scoop of the exemplary embodiment of a temperature-controlled case of FIG. 1A.

Referring to FIGS. 4 and 5, each scoop 140 is shown as a formed or molded sheet including a first scoop portion 142 generally above a second scoop portion 144 and a bend 146. Scoops 140 are configured to receive and direct first portion 74 of air flow 70 discharged from air outlet 68 of cooling system 22 towards deck 54. Each scoop 140 is shown spaced a distance from intermediate wall 24, allowing for first portion 74 of air flow 70 to flow substantially in front of scoops 140. First scoop portions 142, bends 146, and second scoop portions 144 at least partially define a flow path for first portion 74 of air flow 70. Air discharged from air outlet 68 flows along scoops 140 and into cavity 94. Second scoop portions 144 are shown as substantially planar panels (e.g., flaps, foils, walls, etc.) that extend at least partially beneath bottom 84 of intermediate wall 24 and toward air outlet 68 to receive first portion 74 of air flow 70. Second scoop portions 144 are shown disposed at an angle relative to first scoop portions 142. First scoop portions 142 are shown substantially planar and at least partially disposed in cavity 94 substantially parallel to intermediate wall 24. Bends 146 at least partially define the transition between second scoop portions 144 and first scoop portions 142, facilitating the change in direction of first portion 74 of air flow 70 as it flows from along second scoop portions 144 to along first scoop portions 142. Bends 146 are shown substantially uncurved, but, alternatively, may be curved, partially curved, or otherwise shaped in any manner configured to help transition the flow of the first portion of the air flow from along the first scoop portions to along the second scoop portions. The degree of the bend may be varied to achieve a desired flow path, air distribution, and/or air velocity. The scoops are shown generally made of formed sheets of metal, however, according to other embodiments may be molded/formed sheets of plastic, or other materials known in the art. Also, the second scoop portion may be configured extend to various distances below the intermediate wall in order to achieve a desired air flow velocity and air flow distribution.

Figure 6:
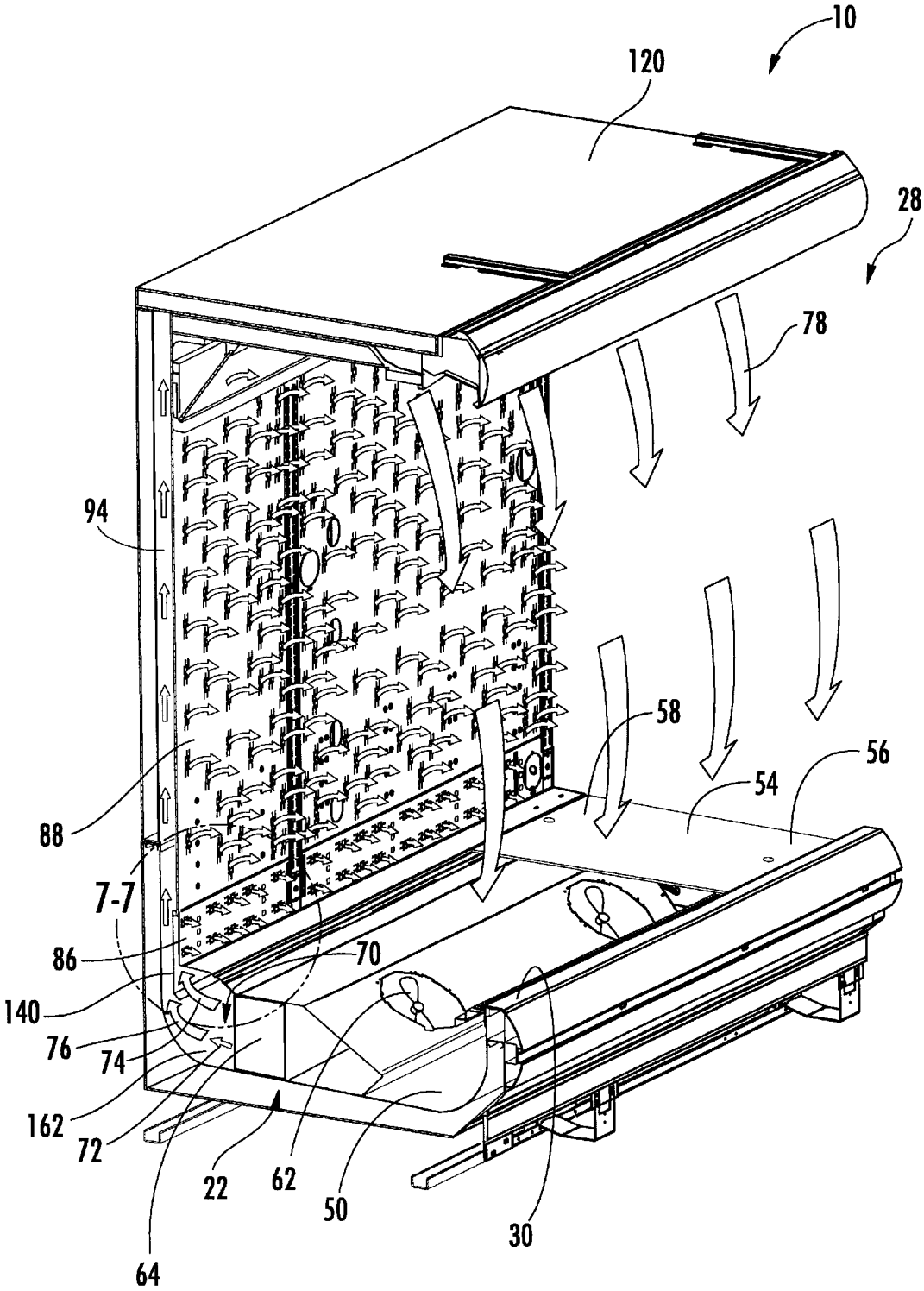
FIG. 6 is a perspective cross-sectional view of the exemplary embodiment of a temperature-controlled case of FIG. 1A along the line 6-6.

Referring to FIGS. 6 and 7, a plurality of plenums 152 disposed at least partially within cavity 94 are shown according to an exemplary embodiment. Plenums 152 are configured to receive first portion 74 of air flow 70 directed into cavity 94 by scoops 140. Plenums 152 are further configured to confine first portion 74 of air flow 70 substantially between first scoop portion 142 and lower portion 86 of intermediate wall 24 for discharge through only openings 90 in lower portion 86 of intermediate wall 24. Scoops 130 are shown coupled or disposed relative to intermediate wall 24 to define plenums 152 at least partially between first portions 142 of scoops 130 and intermediate wall 24. An inlet 154 to each plenum 152 is generally defined between each scoop 140 and intermediate wall 24. Inlets 154 are configured to permit first portion 74 of air flow 70 to flow therethrough and into plenums 152. Plenums 152 are not provided with outlets other than openings 90 in lower portion 86 of intermediate wall 24. A plurality of upper barriers 156 disposed proximate the tops of plenums 152 are configured to further define plenums 152 and to prevent first portion 74 of air flow 70 from exiting plenums 152 and flowing upward toward openings 92 of upper portion 88 of intermediate wall 24. Additionally, a plurality of side flanges 150 are shown substantially defining the sides of plenum 152, helping to prevent first portion 74 of air flow 70 from exiting each plenum 152 at its sides (see, e.g., FIG. 5 illustrating side flanges 150). According to other embodiments, other features of the scoop, the intermediate wall, and/or other components of the refrigerated case may define the plenums.

Referring further to FIG. 7, upper barrier 156 is shown extending substantially between first scoop portion 142 and intermediate wall 24 according to an exemplary embodiment. Openings 90 of lower portion 86 of intermediate wall 24 are disposed substantially below the location at which upper barrier 156 and intermediate wall 24 converge, and openings 92 of upper portion 88 of intermediate wall 24 are disposed substantially above the location at which upper barrier 156 and the intermediate wall converge. First portion 74 of air flow 70 flows in front of scoop 140 into plenums 152. Plenums 152 substantially correspond to openings 90 of lower portion 86. Plenums 152 substantially cover or enclose openings 90, separating them from the remainder of cavity 94 and at least partially preventing the second portion 76 of air flow 70 from flowing through openings 90 of lower portion 86 of intermediate wall 24. Openings 90 of lower portion 86 provide an exit through which first portion 74 of air flow 70 may be discharged. Upper barrier 156 helps creates a flow differential that helps direct or force first portion 74 of air flow 70 through openings 90 of lower portion 86.

Referring to FIG. 7, according to an exemplary embodiment, upper barriers 156 are substantially formed where upper flanges 158 of scoops 140 are coupled to upper flanges 160 of lower portion 86 of intermediate wall 24. Upper flanges 158 of scoops 140 are shown extending toward intermediate wall 24 from first scoop portion 142. Upper flanges 160 of lower portion 86 of intermediate wall 24 are shown extending toward first scoop portions 142 according to an exemplary embodiment. In other embodiments, the upper barrier may be any wall, side, or other obstruction that substantially prevents the first portion of the air flow from exiting the plenums other than through the openings of the lower portion of the intermediate wall. Also, any wall, side, or other obstruction may be provided at the sides of the plenums that substantially prevents the first portion of the air flow from exiting the plenums other than through the openings in the lower portion of the intermediate wall.

Referring back to FIGS. 6 and 7, scoops 140 are further configured to permit second portion 76 of air flow 70 discharged from air outlet 68 of cooling system 22 to be received in cavity 94 and be directed toward shelves 26 according to an exemplary embodiment. Scoops 140 are shown spaced a distance from rear wall 32 of frame, allowing second portion 76 of air flow 70 to flow substantially rearward of scoops 140. Second scoop portions 144 are also shown spaced a distanced from bottom wall 34 of frame 20, providing second portion 76 of air flow 70 an inlet 148 (e.g., entrance, opening, hole, etc.) to cavity 94. An air directing feature shown as a surface 162 is configured to a least partially direct second portion 76 of air flow 70 into cavity 94. Surface 162 is shown at least partially curved, defining an at least partially curved air flow path along which second portion 76 of air flow 70 may flow into cavity 94. Second portion 76 of air flow 70 flows rearward of scoop 140 and generally between rear wall 32 and scoop 140. Plenums 152 substantially prevent second portion 76 of air flow 70 from accessing and being discharged through openings 90 of lower portion 86. Second portion 76 of air flow 70 then flows above scoops 140, where second portion 76 of air flow 70 is provided access to openings 92 in upper portion 88 of intermediate wall 24. Canopy 120 helps create a pressure differential to discharge second portion 76 of air flow 70 through openings 92. According to one embodiment the air directing feature may be a substantially uncurved surface forming a 90 degree angle. According to another embodiment, surface 162 may be substantially uncurved and form an angle other than a 90 degree angle. According to other embodiments, the air directing feature may be any feature, element, or device that provides for receipt of second portion 76 of air flow 70 in cavity 94 by providing a flow path thereto (e.g., a duct, an elbow, a tube, a conduit, etc.). Also, the spacing of scoops relative to the rear wall of the frame and the intermediate wall in the cavity may be configured to achieve desired air flow velocity and air flow distribution.

Referring back to FIG. 4, each scoop 140 is shown aligned proximate rear wall 32 of frame 20 and substantially corresponding to one segment 102 of rear wall 32 according to an exemplary embodiment. Each scoop 140 is shown disposed between frame members 100 defining the segments of rear wall 32 and coupled thereto at a pair of side flanges 150. In another embodiment, a single scoop extends substantially continuously along the rear wall. In other embodiments, the scoops are not segmented. In still other embodiments, sides, members, walls, sheets, etc. may further help define plenums.

While scoops 140 are shown spaced apart horizontally, in another embodiment, one or more scoops may be spaced apart substantially depthwise and/or substantially vertically in the refrigerated case. For example, the first portions of a plurality of scoops may each be at least partially disposed within the cavity between the intermediate wall and the rear wall such that the first portions are generally aligned and spaced apart from front to back between the rear wall and the intermediate wall. The first portions of the scoops closer to the rear wall may generally extend closer to the top of the intermediate wall than the first portions of the scoops closer to the intermediate wall. The second portions of the scoops extend at least partially beneath the intermediate wall and towards the air outlet of the cooling system to receive a portion of the air flow. The second portions of scoops closer to the rear wall may extend down farther than the second portions of the scoops closer to the intermediate wall. Each scoop may correspond to a different set of openings in the intermediate wall and be configured to discharge a portion of the air flow therethrough. The scoops may get smaller (e.g., shorter, etc.) closer to intermediate wall such that scoops closer to intermediate wall are essentially nested in, though spaced apart from, the scoops closer to the rear wall.

Referring back to FIG. 2, the operation of air distribution system 28 is shown according to an exemplary embodiment. Air distribution system 28 provides for distribution of first portion 74 of air flow 70 toward product support surface (e.g., deck) disposed adjacent or proximate to lower portion 86 of intermediate wall 24. First portion 74 of air flow 70 is shown directed by air distribution system 28 toward deck 54 through openings 90 in lower portion 86 of intermediate wall 24. Air distribution system 28 further provides for distribution of second portion 76 of air flow 70 toward product support surfaces (e.g., shelves) disposed adjacent or proximate to upper portion 88 of intermediate wall 24. Second portion 76 of air flow 70 is shown directed by air distribution system 28 toward shelves 26 through openings 92 in upper portion 88 of intermediate wall 24. In this manner, air distribution system 28 provides for enhanced air flow throughout refrigerated case 10, provides for balanced cooling of products displayed in refrigerated case 10, and substantially maintains the products displayed in refrigerated case 10 at a uniform temperature.

Discharge air flow portion 72 of air flow 70 is discharged from air outlet 68 of cooling system 22. Discharge air flow portion 72 is shown flowing generally rearward toward rear wall 32 of frame 20. Scoops 140 receive and redirect first portion 74 of discharge air flow portion 72 (e.g., intercepts, diverts, etc.). Scoops 140 further permit second portion 76 of discharge air flow portion 72 to flow therebeneath and be received in cavity 94.

Referring to FIGS. 6 and 7, first portion 74 of air flow 70 is shown encountering second scoop portions 144 according to an exemplary embodiment. Upon encountering second scoop portions 144, first portion 74 of air flow 70 flows generally along second scoop portions 144 towards bends 146. Bends 146 transition first portion 74 of air flow 70, changing the direction of flow of first portion 74 of air flow 70 from along second scoop portions 144 to along first scoop portions 142. This flow path directs (e.g., guides, routes, etc.) first portion 74 of air flow 70 in front of scoops 140 and into plenums 152. First portion 74 of air flow 70 is substantially confined within plenums 152. Upper barrier 156 acts as a flow restriction, decreasing the velocity of first portion 74 of air flow 70 and creating a pressure differential. The pressure differential created by upper barriers 156 helps direct (e.g., force, guide, discharge, etc.) first portion 74 of air flow 70 through openings 90 in lower portion 86 and toward deck 54, providing for cooling of products supported on deck 54 or thereabove on grate 60. After flowing along deck 54 from intermediate wall 24 toward front wall 30, air exiting openings 90 of lower portion 86 may be drawn into air return 126 by fans 62 proximate front portion of deck 54. Fans 62 then direct this air, as at least part of return air flow portion 80, toward cooling system 22 where it is cooled and recirculated.

Referring further to FIGS. 6 and 7, second portion 76 of air flow 70 is shown flowing beneath scoops 140 and encountering surface 162 according to an exemplary embodiment. Second portion 76 of air flow 70 flows at least partially along surface 162, which directs second portion 76 of air flow 70 into cavity 94 rearward of scoops 140, which are disposed at least partially within cavity 94. Second portion 76 of air flow 70 then flows substantially upward in front of rear wall 32, but rearward of scoop 140. Plenums 152 prevent second portion 76 of air flow 70 or sub-portions thereof from being discharged through openings 90 of lower portion 86 of intermediate wall 24. When second portion 76 of air flow 70 flows above upper barriers 156, second portion 76 of air flow 70 is provided access to openings 92 of upper portion 88. Canopy 120, disposed at least partially above cavity 94, is configured to help generate a pressure differential to discharge second portion 76 of air flow 70 from openings 92. Sub-portions of second portion 76 of air flow 70 are discharged or flow through openings 92 in upper portion 88 toward shelves 26, providing for cooling of products supported on shelves 26.

Referring back to FIG. 2, the remaining portion of second portion 76 of air flow 70 that is not distributed through openings 92 in upper portion 88 of intermediate wall 24 flows at least partially out of cavity 94 at the top and into canopy 120. Canopy 120 directs the remaining air downward toward front wall 30 of frame 20, forming air curtain 78. As discussed above, air curtain 78 enhances the performance of refrigerated case 10 by providing a boundary or separation between the refrigerated interior or product space of refrigerated case 10 and the warmer ambient environment external to the case. As air curtain 78 approaches front wall 30 of frame 20 it is drawn into air return 126 by fans 62. Fans 62 in turn direct this air, as at least part of return air flow portion 80, through cooling system 22 where it is cooled and recirculated.

Figure 8B:
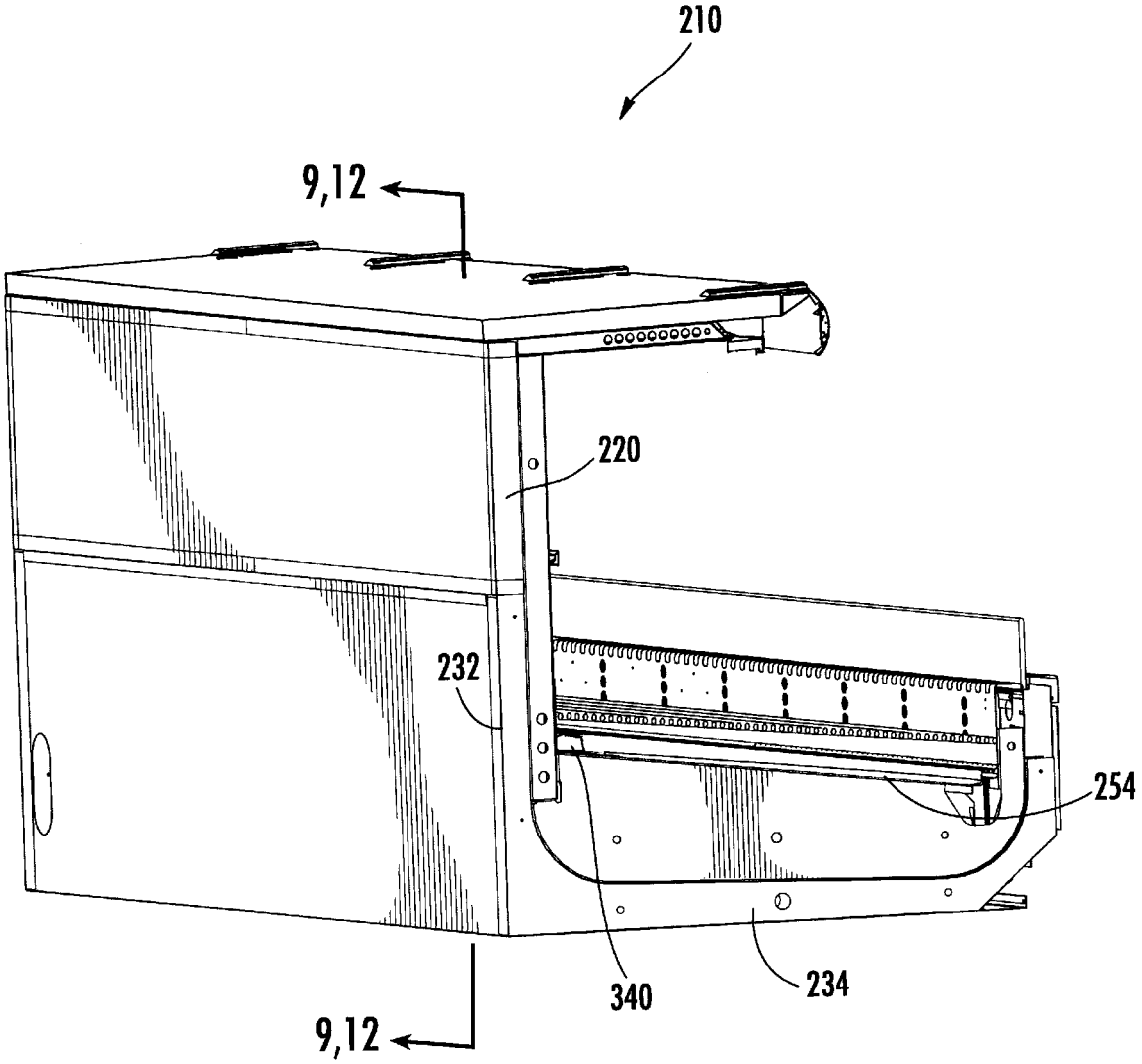
FIG. 8B is a rear perspective view of the exemplary embodiment of a temperature-controlled case of FIG. 8A.
Figure 9:
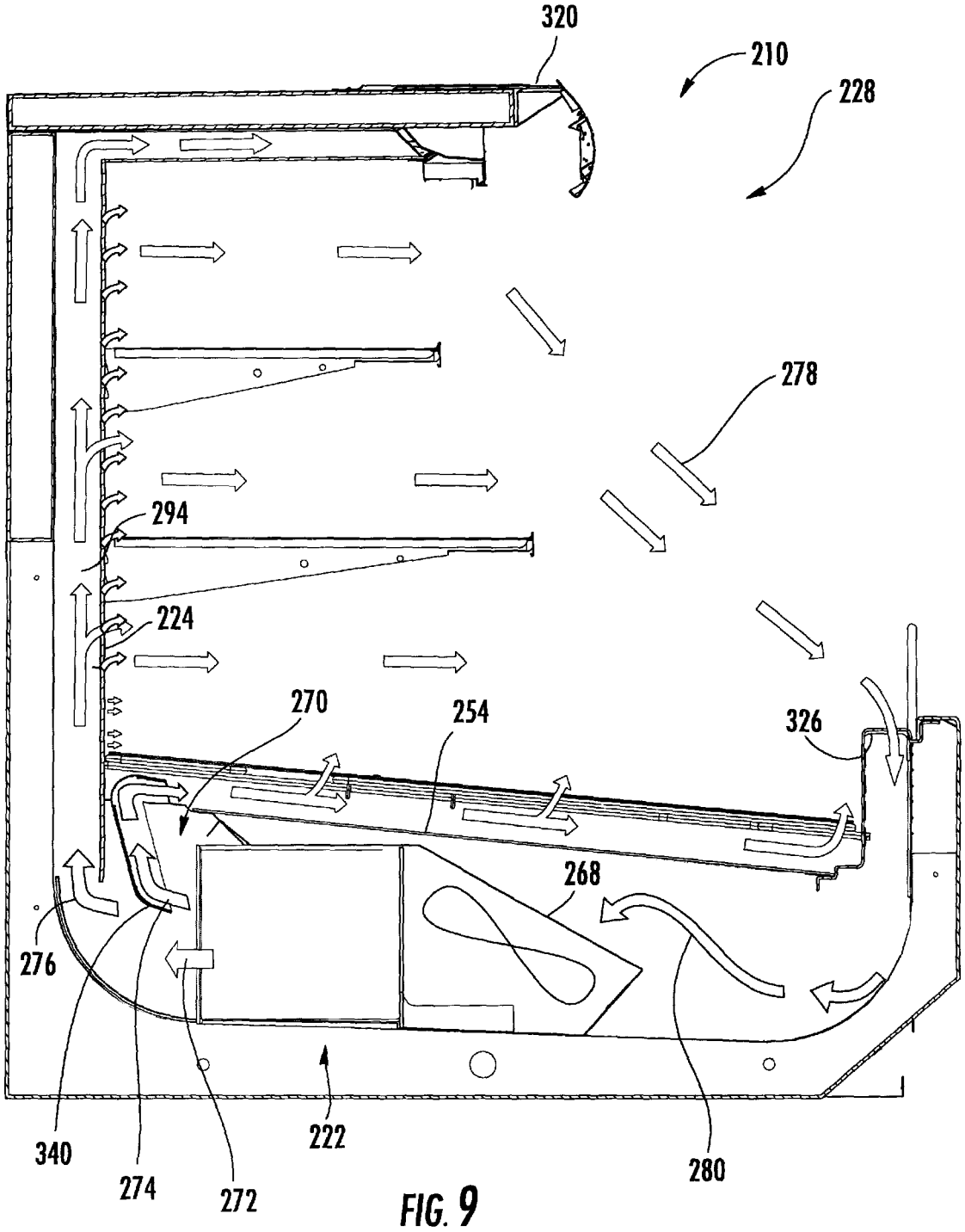
FIG. 9 is a side plan, cross-sectional view of the exemplary embodiment of a temperature-controlled case of FIG. 8A along line 9-9, illustrating the air flow.

Referring to FIGS. 8A-9, a second embodiment of the refrigerated case shown as refrigerated case 210 is disclosed including an air distribution system 228 having a plurality of air diverting devices shown as scoops 340.

Referring to FIGS. 8A and 8B, refrigerated case 210 further includes a cooling system 222, an intermediate wall 224, a plurality of shelves 226, and a frame 220 having a front wall 230 and a rear wall 232 (similar to cooling system 22, intermediate wall 24, shelves 26, frame 20, front wall 30, and rear wall 32 previously described). Frame 220 of refrigerated case 210 further includes a deck 254 and a cavity 294 defined between intermediate wall 224 and rear wall 232 (similar to cavity 94 and deck 54 previously described).

Referring to FIG. 9, cooling system 222 provides an air flow 270. Air flow 270 is shown according to a second exemplary embodiment including a discharge air flow portion 272. Discharge air flow portion 272 includes at least a first portion 274 and a second portion 276. Air flow 270 is further shown including an air curtain 278 and a return air flow portion 280. Air flow 270 is distributed throughout refrigerated case 210 by air distribution system 228.

Referring to FIG. 9, scoops 340 are configured to receive and direct a first portion 274 of air flow 270 away from cavity 294 and toward deck 254. Scoops 340 are further configured to permit a second portion 276 of air flow 270 to be received in cavity 294 and directed toward shelves 226. Scoops 340 are spaced a distance from bottom wall 234, thereby permitting second portion 276 of air flow 270 to flow therebeneath and into cavity 294.

Figure 10:
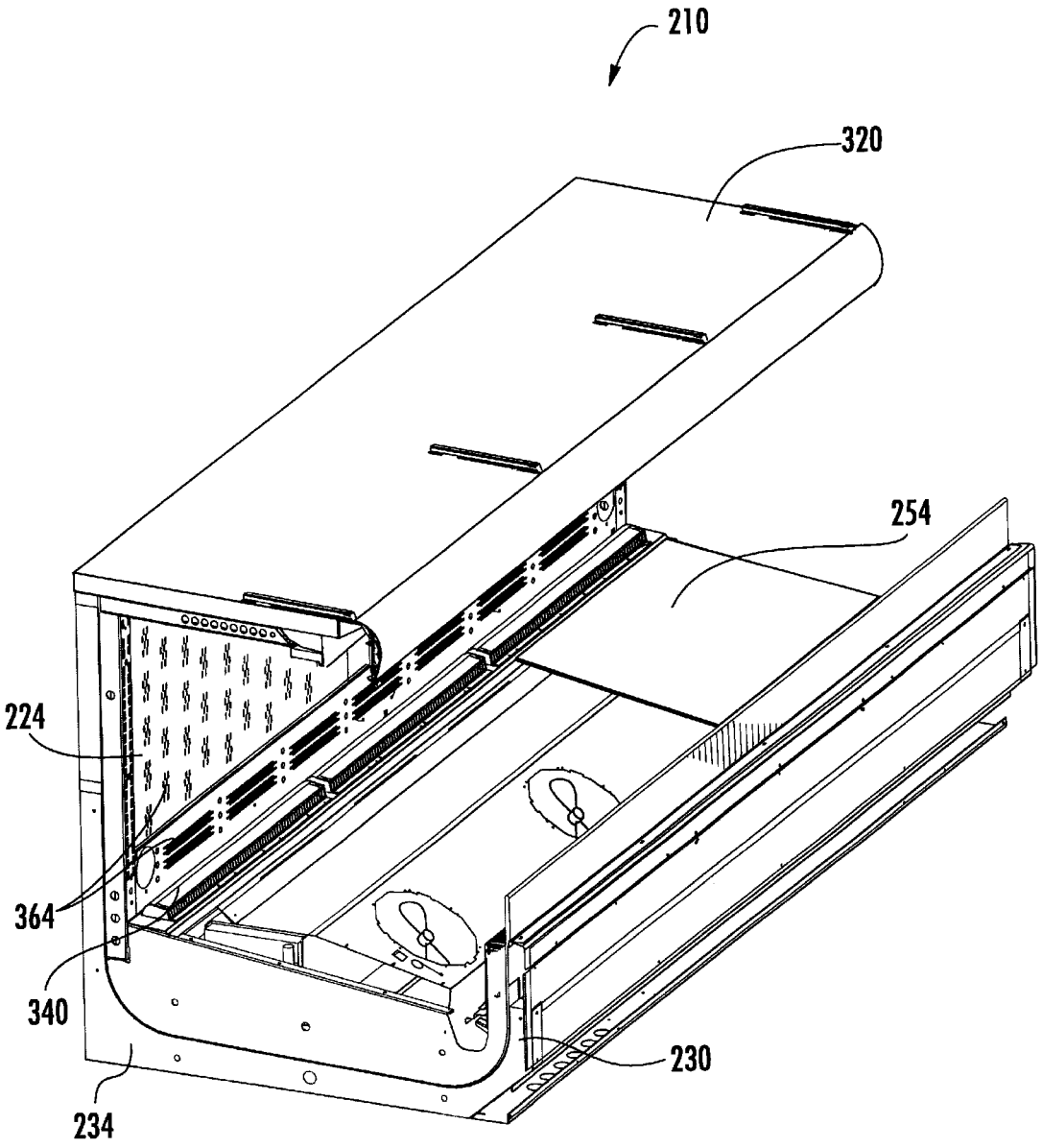
FIG. 10 perspective view of the exemplary embodiment of a temperature-controlled case of FIG. 8A.
Figure 11:
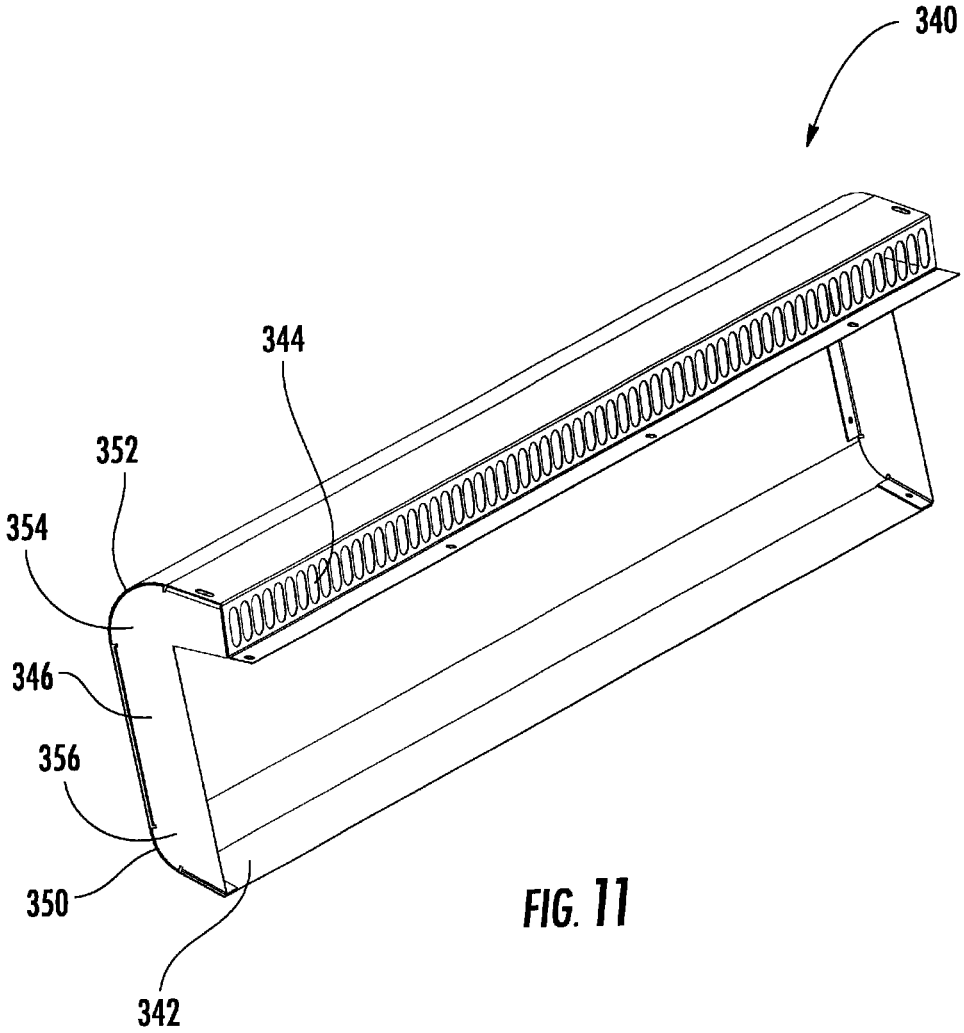
FIG. 11 is a perspective view of a scoop of the exemplary embodiment of a temperature-controlled case of FIG. 8A.
Figure 12:
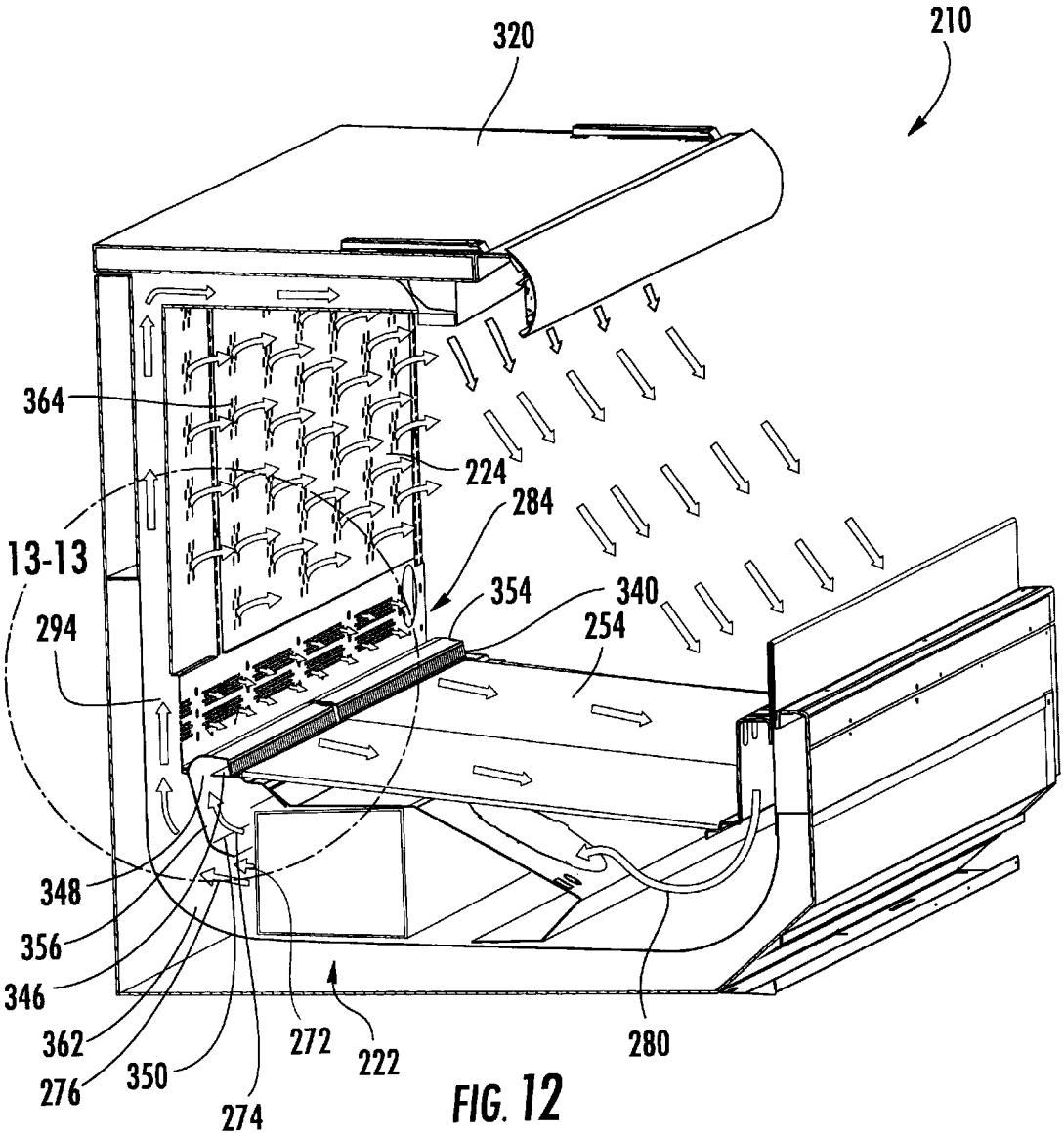
FIG. 12 is a perspective cross-sectional view of the exemplary embodiment of a temperature-controlled case of FIG. 8A along the line 12-12 illustrating the air flow.

Referring to FIGS. 10 and 11, each scoop 340 includes an air inlet 342, an air outlet 344, and a body 346 extending therebetween according to an exemplary embodiment. Both air inlets 342 and air outlets 344 are shown disposed in front of intermediate wall 224. Bodies 346 of scoops 340 are shown extending through deck 254 to define passages 348 between air inlets 342 shown below deck 254 and air outlets 344 shown above deck 254 (see, e.g., FIG. 12 illustrating passage 348). Air outlets 344 are further shown including a plurality of slots. Bodies 346 are further shown including a first bend 350 substantially below deck 254 and a second bend 352 substantially above deck 54. First bends 350 and second bends 352 are at least partially curved and define an at least partially curved flow path through bodies 346. The angle and radius of each bend 350, 352 affects the directional change of first portion 274 of air flow 270 through and/or along scoops 140. The size and/or shape of air inlets 342 and air outlets 344 may be adjusted to achieve a desired air flow distribution and/or air flow velocity. Also, the angle and radius of each bend 350, 352 can be adjusted to achieve a desired air flow velocity and direction. According to one embodiment, first bends 350 and second bends 352 have substantially the same angle and radius. According to other embodiments, first bends 350 and second bends 352 have different angles and/or different radii. According to other embodiments, bends 350, 352 may be uncurved bends. According to other embodiments, the air outlets may have slots or other openings sized, shaped, and/or arranged in any manner to achieve a desired air flow and/or air flow velocity.

Referring to FIGS. 11 and 12, a first portion 354 of each body 346 is disposed at least partially below deck 254 and a second portion 356 of each body 346 is disposed at least partially above deck 54. First portions 354 of bodies 346 are shown substantially vertical, extending below deck 254 and generally in front of or proximate to an air outlet 268 of cooling system 222 to receive first portion 274 of air flow 270 therein. Second portions 356 of bodies 346 are shown substantially horizontal, extending along substantially horizontal deck 254 toward front wall 230 for a distance. A desired air flow distribution and/or air flow velocity may be achieved by adjusted by the distance that first portion 354 extends below deck. All else equal, the farther the first portions 356 of bodies 346 of scoops 340 extend below the deck 254, the greater the volume of the first portion of the air flow that is received in scoops 340. According to other embodiments, the first portions and the second portions may be disposed at any of a number of angles relative to each other and/or the deck.

Figure 13:
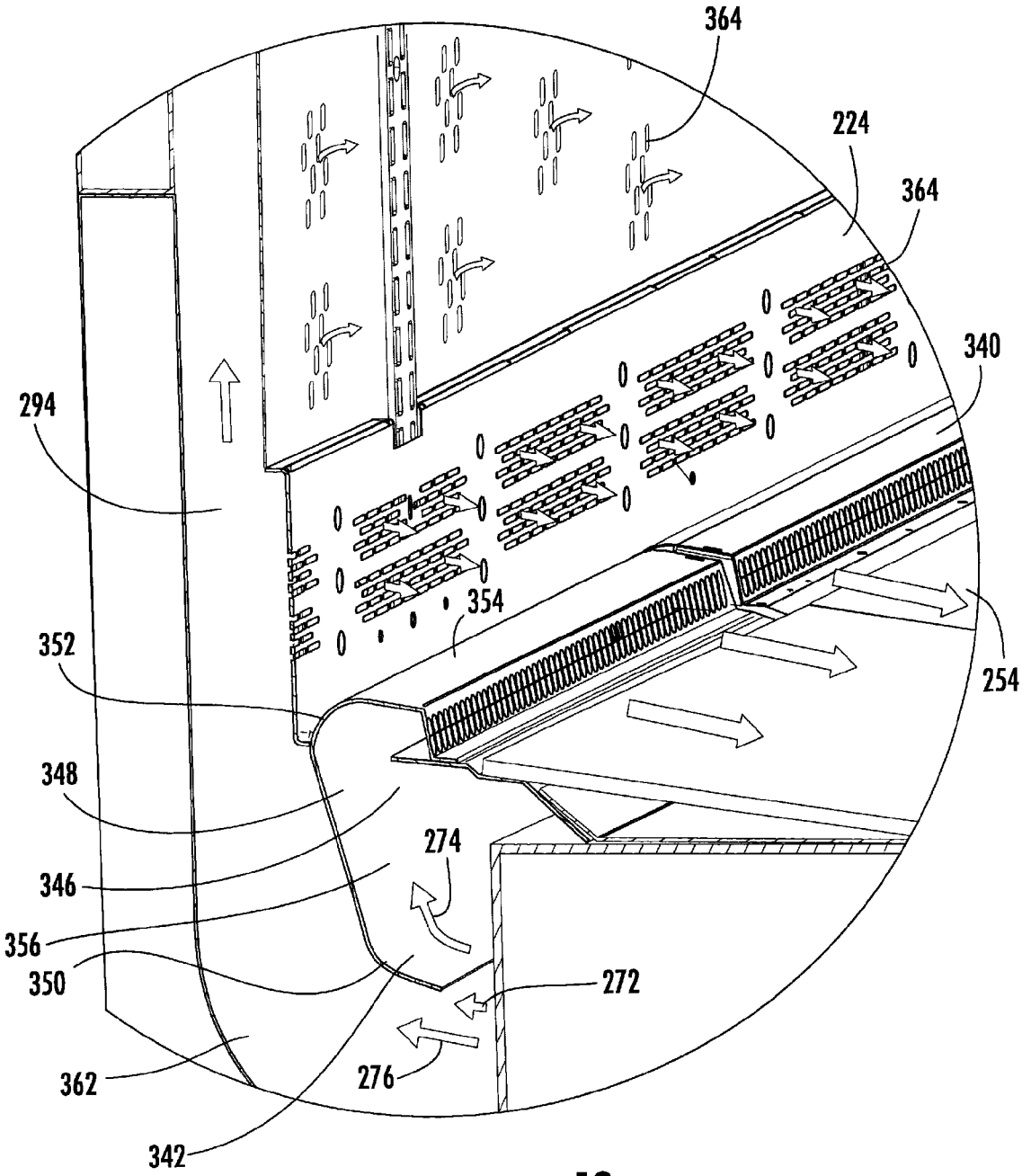
FIG. 13 is a detailed view of FIG. 12 taken along line 13-13.

Referring to FIGS. 12 and 13, the operation of air distribution system 228 is shown according to an exemplary embodiment. Air distribution system 228 provides for distribution of first portion 274 of air flow 270 toward deck 254. Deck 254 is shown disposed adjacent or proximate to a bottom 284 of intermediate wall 224. First portion 274 of air flow 270 is shown directed by away from cavity 294 toward deck 254 by scoops 340. Air distribution system 228 further provides for distribution of second portion 276 of air flow 270 toward deck 254 and shelves 226. Shelves 226 are shown disposed adjacent or proximate to intermediate wall 224 above deck 254. In this manner, air distribution system 228 provides for enhanced air flow throughout refrigerated case 210, provides for balanced cooling of products displayed in refrigerated case 210, and substantially maintains the products displayed within refrigerated case 210 at a uniform temperature.

Referring to FIG. 12, discharge air flow portion 272 of air flow 270 is discharged from air outlet 268 of cooling system 222. Discharge air flow portion 272 flows generally rearward toward rear wall 232 of frame 220. Scoops 340 receive and direct (e.g., intercept, divert, etc.) first portion 274 of air flow 270 away from cavity 294 and towards deck 254. Scoops 340 further permit second portion 276 of air flow 270 to flow therebeneath and into cavity 94.

Referring to FIG. 13, first portion 274 of air flow 270 is shown encountering air inlets 342 of scoops 340 as discharge air flow portion 272 flows substantially rearward according to an exemplary embodiment. Air inlets 342 receive first portion 274 of air flow 270. First portion 274 of air flow 270 flows through passages 348 defined by bodies 346 of scoops 340. First bends 350 of scoop bodies 346 direct first portion 274 of air flow 270 generally vertically upward and above deck 254. Above deck 254, first portion 274 of air flow 270 encounters second bends 352. Second bends 352 of scoop bodies 346 direct first portion 274 of air flow 270 generally horizontally. First portion 274 of air flow 270 then flows substantially horizontally through passages 348 toward front wall 230 of frame 220 until it is discharged from air outlets 344 of scoops 340. Upon being discharged from air outlets 344, first portion 274 of air flow 270 flows along deck 254 towards front wall 230 until being drawn into an air return 326 and directed, as at least part of return air flow portion 280, toward cooling system 22 where it is cooled and recirculated.

Referring further to FIG. 13, second portion 276 of air flow 270 is shown flowing at least partially beneath scoops 340 and intermediate wall 224 where it encounters a surface 362 according to an exemplary embodiment. Surface 362 is configured to at least partially direct second portion 276 of air flow 270 into cavity 294. Second portion 276 of air flow 270 flows generally along surface 362 into cavity 294. Second portion 276 of air flow 270 is shown flowing through cavity 294 until being discharged from a plurality of openings 364 in intermediate wall 224. A canopy 320, shown disposed at least partially above cavity 294, is configured to help generate a pressure differential that helps discharge second portion 276 from openings 364 in intermediate wall 224. Second portion 276 of air flow 270 flows through openings 364 toward shelves 226, providing for cooling of products supported on shelves 226.

Referring back to FIG. 12, the remaining portion of second portion 276 of air flow 270 that is not distributed through openings 364 of intermediate wall 224 flows out of the top of cavity 294 and into canopy 320. Canopy 320 helps direct the remaining air generally downward toward front wall 230 of frame 220, forming air curtain 278. As discussed above, air curtain 278 enhances the performance of refrigerated case 210 by providing a boundary or separation between the refrigerated interior or product space of refrigerated case 10 and the warmer ambient environment external to the case. As air curtain 278 approaches front wall 230 of frame 220, it is drawn into air return 326 and directed, as at least part of return air flow portion 280, toward cooling system 222 where it is cooled and recirculated.

Figure 14:
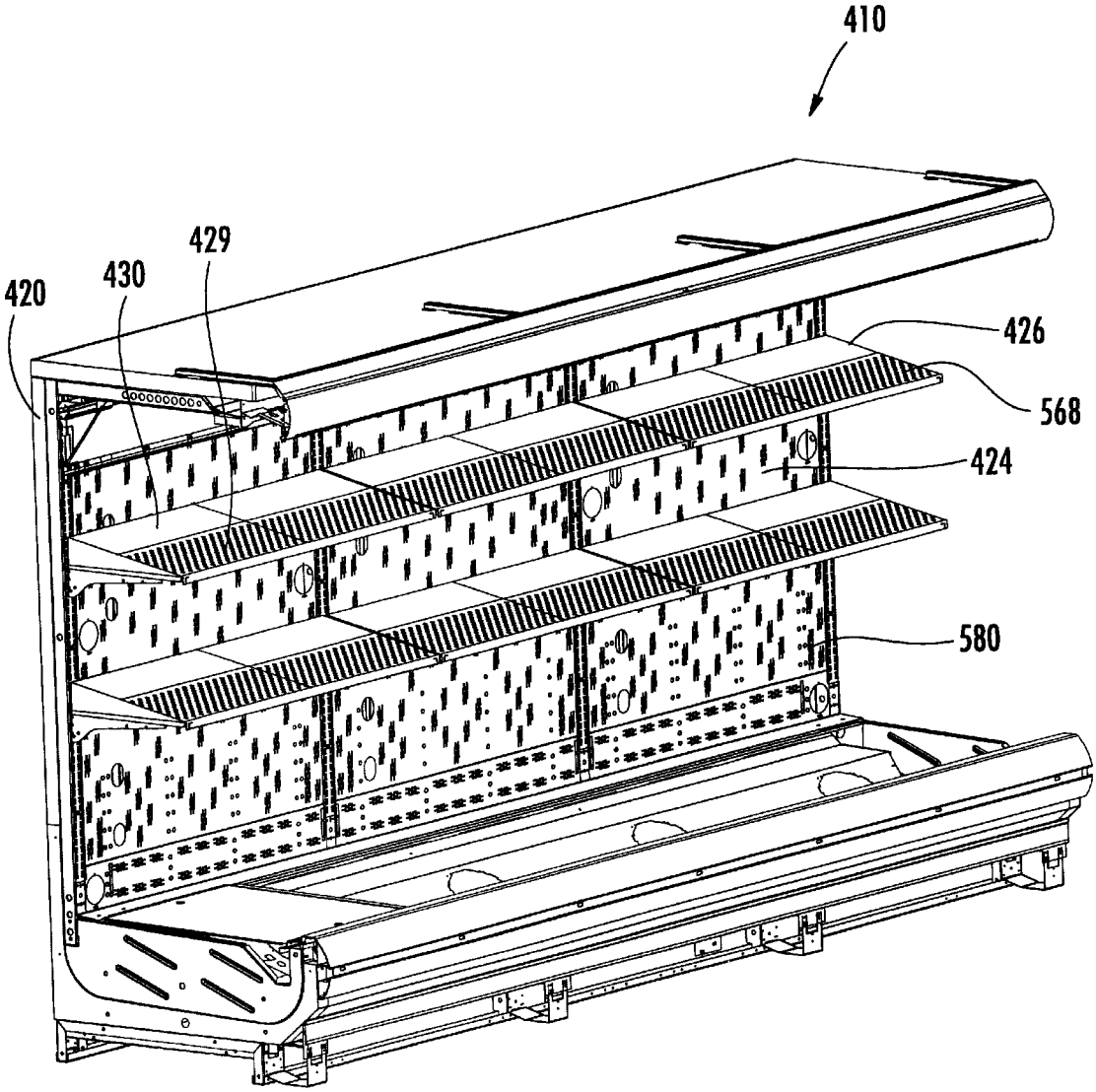
FIG. 14 is a front perspective view of a temperature-controlled case having shelves according to a third embodiment.
Figure 15:
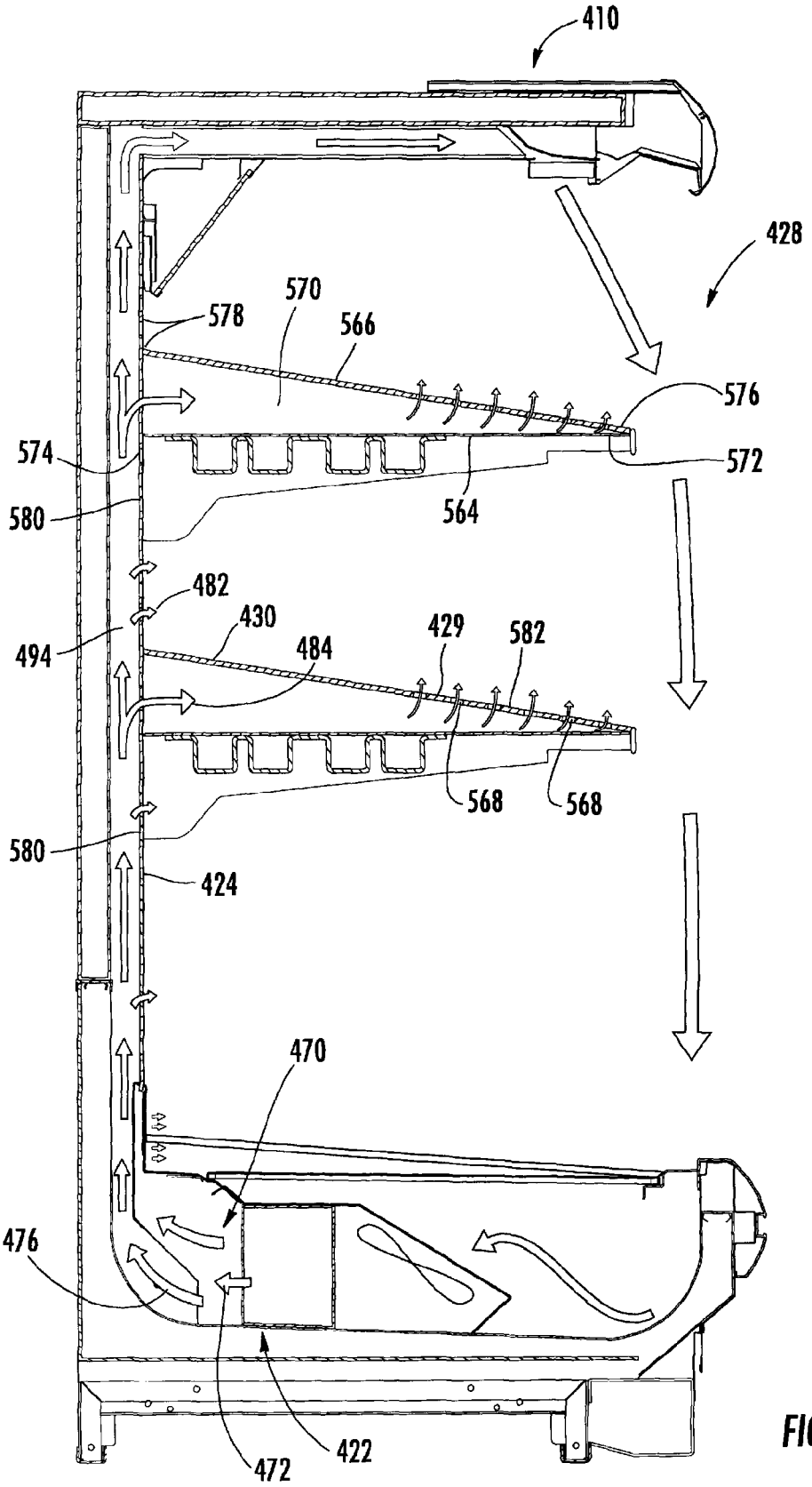
FIG. 15 is a perspective cross-sectional view of the exemplary embodiment of a temperature-controlled case of FIG. 14 along line 15-15 and illustrating the air flow through the shelf.

Referring to FIGS. 14 and 15, a plurality of shelves 426 are provided in refrigerated case 410 according to a third exemplary embodiment.

Referring to FIG. 14, refrigerated case 410 further includes a cooling system 422 configured to discharge an air flow 470, an intermediate wall 424, a plurality of shelves 426, an air distribution system 428, and a frame 420 (similar to cooling system 22, air flow 70, intermediate wall 24, shelves 26, air distribution system 28, and frame 20 previously described). Frame 420 of refrigerated case 410 further includes a cavity 494 defined between intermediate wall 224 and rear wall 232 (similar to cavity 94 previously described).

Referring to FIG. 15, cooling system 422 provides an air flow 470. Air flow 470 is shown according to a second exemplary embodiment including a discharge air flow portion 472. Discharge air flow portion 472 has at least one portion 476. Portion 476 of air flow has a plurality of sub-portions, including a first sub-portion 482 and a second sub-portion 484.

Referring further to FIGS. 14 and 15, each shelf 426 includes a front portion 429 and a rear portion 430, wherein rear portion 430 of each shelf 426 is generally open and disposed adjacent or proximate to intermediate wall 424. Each shelf 426 further includes a shelf base 564, a shelf cover 566 having a plurality of openings 568, and a space 570 defined therebetween. Shelf covers 566 are shown disposed at an angle relative to shelf bases 564 and coupled thereto. Each shelf base 564 includes a front edge 572 and a rear edge 574. Each shelf cover 566 includes a front edge 576 and a rear edge 578. Front edge 576 of each shelf cover 566 is coupled to front edge 572 of the corresponding shelf base 564. Rear edge 578 of each shelf cover 566 is spaced a distance from rear edge 574 of the corresponding shelf base 564. Spaces 570 are shown as a wedge-shaped spaces defined by the shelf cover and shelf base pairings. Spaces 570 generally extend from the rear edges toward the front edges of each shelf cover and shelf base pairing. Shelf covers 566 are configured to be adjustable relative to shelf bases 564, providing for the cross-section of spaces 570 defined therebetween to be adjusted. In the embodiment shown, the angle of shelf covers 566 relative to shelf bases 564 may be adjusted, changing the angle and/or the cross-section of spaces 570 therebetween. The shelf covers may be adjusted to achieve a desired air flow and/or air flow velocity.

Referring to FIG. 15, openings 568 in shelf covers 566 are configured to distribute one or more sub-portions of portion 476 of air flow 470 received in spaces 570 through a plurality of openings 580 in intermediate wall 424. Openings 568 are shown as circular holes disposed at a front portion 582 of each shelf cover 566 of shelves 426 and arranged in a pattern. The openings in the shelf covers are sized, shaped, and/or arranged in a pattern intended to achieve a desired distribution of air flow and/or maintain a desired air flow velocity. Openings 568 may vary in size, shape, pattern, and/or arrangement (e.g., the shelf cover openings may include large circular holes and/or a series of openings forming a honeycomb patterns, etc.). In some embodiments, openings 568 in shelf covers 566 may get progressively larger the higher the shelf is disposed relative to intermediate wall 424 (e.g., the closer to the top of the intermediate wall) in order to achieve a desired air flow and/or air flow velocity.

According to other embodiments, openings 568 in shelf covers 566 may form a first pattern on one shelf and a second pattern on a shelf thereabove. The first pattern and the second pattern may be the same. Alternatively, the first pattern and the second pattern may differ. In another embodiment, the openings in the shelf cover of each shelf may be the same size, but may become progressively more numerous the higher the shelf is disposed relative to the intermediate wall. In some embodiments, the openings in the shelf covers of a plurality of shelves increase in both size and number the higher each shelf is disposed relative to the intermediate wall.

Referring further to FIG. 15, each shelf 426 is disposed relative to intermediate wall 424 such that at least some openings 580 are located above each shelf cover 566 and some openings 580 are located between each shelf cover 566 and shelf base 564 pairing. Openings 580 above each shelf cover 566 are intended to distribute sub-portions (e.g., first sub-portion 482) of portion 476 of air flow 470 above and generally along each shelf cover 566 (e.g., in a first flow path). These sub-portions are primarily directed at rear portions 430 of shelves 426. Openings 580 between each shelf cover 566 and corresponding shelf base 564 are intended to distribute sub-portions (e.g., second sub-portion 484) of portion 476 of air flow 470 into spaces 570 therebetween. The sub-portions of portion 476 of air flow 470 received in spaces 570 are distributed through openings 568 (e.g., in a second flow path). As openings 568 are disposed toward front portions 582 of shelf covers 566, the sub-portions of portion 476 of air flow 470 received in spaces 570 are primarily directed at front portions 429 of shelves 426. Spaces 570 in shelf covers 566 may be configured to achieve a desired velocity of the sub-portions of portion 476 of air flow 470 flowing through openings 568 (e.g., the spaces may have a cross section that generally decreases moving from the rear portion toward the front portion of each shelf, such as the wedge shaped space discussed above, etc.). In other embodiments, the shelf cover and the shelf base may be integrally formed in any manner wherein a space is defined therebetween, or the shelves may not include shelf covers.

According to any preferred embodiment, a straight case is provided with a frame, a cooling system, an intermediate wall, a plurality of shelves, and an air distribution system. The frame includes a front wall and a rear wall. The cooling system includes an air flow device providing an air flow discharged through an air outlet. The intermediate wall is spaced a distance from the rear wall to define a cavity. The cavity may extend substantially vertically. The intermediate wall includes a plurality of openings through which air may be discharged. The plurality of openings may include a first set of openings disposed substantially below a second set of openings. Each shelf may include a front portion and a rear portion. The rear portions of the shelves may be disposed proximate the second set of openings such that the air discharged from these openings is directed toward the shelves. A deck extending at least partially between the intermediate wall and the front wall of the frame and having a front portion and a rear portion is also provided. The rear portion of the deck is disposed proximate the first set of openings such that air discharged from these openings is directed toward the deck. The air distribution system includes one or more air diverting devices each having first portion substantially above a second portion and a bend defining the transition between the first portion and the second portion. The first portion of the air diverting device is disposed at least partially within the cavity. The second portion of the air diverting device is disposed at an angle relative to the first portion of the air diverting device and extends generally toward the air outlet. The second portion of the air diverting device extends at least partially beneath the intermediate wall. The second portion of the air diverting device may be curved, substantially planar, or partially curved. The air diverting device is configured to direct a first portion of the air flow into the cavity and through the first set of openings and permit a second portion of the air flow to flow into the cavity and be directed through the second set of openings. At least one plenum may be at least partially defined by coupling the air diverting device and the intermediate wall, the plenum being configured to air directed therein by the air diverting device. An upper barrier and/or side flanges may be provided to help prevent the first portion of the air flow from flowing out of the plenum and out of the second set of openings. The plenum may further be configured to prevent the second portion of the air flow, directed generally rearward of the air diverting device, from accessing and exiting through the first set of openings.

According to another preferred embodiment, a straight case is provided with a frame, a cooling system, an intermediate wall, a plurality of shelves, and an air distribution system. The frame includes a front wall and a rear wall. The cooling system includes an air flow device providing an air flow discharged through an cooling system air outlet. The intermediate wall is spaced a distance from the rear wall to define a cavity. The cavity may extend substantially vertically. The intermediate wall includes a plurality of openings through which air may be discharged. Each shelf includes a front portion and a rear portion. The rear portion of each shelf may be disposed proximate the openings in the intermediate wall such that the air discharged from these openings is directed toward the shelves. A deck extending at least partially between the intermediate wall and the front wall of the frame and having a front portion and a rear portion is also be provided. The rear portion of the deck is disposed below the shelves and proximate openings in the intermediate wall. The air distribution system includes at least one air diverting device having a body extending through the deck, at least one air outlet above the deck, and at least one air inlet below the deck. The air inlet and the air outlet may be disposed in front of the intermediate wall. The body of the air diverting device at least partially forms a passage between the air inlet and the air outlet. The body of the air diverting device includes a first portion at least partially above the deck and a second portion below the deck. The body further includes a first bend below the deck and a second bend above the deck. The first and second bends are at least partially curved, defining an at least partially curved flow path therebetween. The air diverting device is configured to direct a first portion of the air flow away from the cavity and toward the deck and permit a second portion of the air flow to flow into the cavity and be directed toward the shelves. The second portion of the air flow is discharged from the cavity through the openings in the intermediate wall. The first portion is discharged through the air outlet of the air diverting device.

According to another preferred embodiment, a straight case is provided with a frame, a cooling system, an intermediate wall, a plurality of shelves, and an air distribution system. The frame includes a front wall and a rear wall. The cooling system includes an air flow device providing an air flow discharged through an cooling system air outlet. The intermediate wall is spaced a distance from the rear wall to define a cavity. The cavity extends substantially vertically. The intermediate wall includes a plurality of openings through which air is discharged. Each shelf includes a front portion and a rear portion. Each shelf further includes a shelf cover disposed generally above a shelf base and a space defined therebetween. The shelf cover is at an angle relative to the shelf base and the space therebetween is a wedge-shaped space. The shelf cover is also adjustable relative to the shelf base to adjust the cross-section of the space therebetween. The rear portion of each shelf is generally open between the shelf cover and the shelf base. Each shelf cover further includes a plurality of openings configured to discharge sub-portions of a portion of the air flow therethrough. The openings in the shelf cover are disposed proximate a front portion of the shelf cover. The air distributions system directs air in a first flow path above the shelf cover toward the rear portion of the shelf. The air distribution system further directs air in a second flow path through the space, out the openings in the shelf cover, and toward the front portion of the shelf. The shelves may be used in combination with one or more air diverting devices having any of a number of configurations.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members, or the two members and any additional intermediate members, being integrally formed as a single unitary body with one another, or with the two members, or the two members and any additional intermediate members, being attached to one another.

It should be noted that the orientation of various elements may differ according to other exemplary embodiments, and that such variations are intended to be encompassed by the present disclosure (e.g., the scoops relative to the tower, the air flow relative to the deck, etc.).

It is also important to note that the construction and arrangement of the refrigerated case as shown in the various exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed herein. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the various exemplary embodiments without departing from the scope of the present inventions.

What is claimed is:

1. A temperature-controlled case, comprising:

a rear wall and a front wall;

an air flow device and an air outlet disposed at least partially between the rear wall and the front wall, the air flow device configured to provide an air flow discharged through the air outlet;

an intermediate wall spaced apart from the rear wall to define a cavity, the intermediate wall including a first plurality of openings having a first pattern defined by a first size, shape and spacing and a second plurality of openings having a second pattern defined by a second size, shape and spacing disposed substantially above the first plurality of openings, the first pattern being different than the second pattern;

at least one air diverting device comprising a first portion substantially parallel to the intermediate wall, an upper barrier connecting an upper edge of the first portion to the intermediate wall, and a second portion extending beneath the intermediate wall toward the air outlet;

the air diverting device configured to receive and direct a first portion of the air flow through the first plurality of openings and away from the second plurality of openings and to permit a second portion of the air flow to be directed through the second plurality of openings and away from the first plurality of openings.

2. The temperature-controlled case of claim 1, wherein the air diverting device is a single air diverting device that extends substantially continuously along the rear wall.

3. The temperature-controlled case of claim 1, wherein the air diverting device comprises a plurality of air diverting devices aligned proximate the rear wall.

4. The temperature-controlled case of claim 3, wherein the rear wall includes a plurality of segments, each of the air diverting devices substantially corresponding to one of the plurality of segments of the rear wall.

5. The temperature-controlled case of claim 1, wherein the air diverting device comprises a formed sheet having a first portion generally above a second portion and a bend defining a transition therebetween.

6. The temperature-controlled case of claim 5, the first portion of the air diverting device being at least partially disposed within the cavity.

7. The temperature-controlled case of claim 6, wherein the second portion of the air diverting device is disposed at an angle relative to the first portion.

8. The temperature-controlled case of claim 6, wherein the second portion of the air diverting device is a substantially planar panel.

9. The temperature-controlled case of claim 6, wherein the air diverting device is coupled to the intermediate wall to define a plenum at least partially between the first portion of the air diverting device and the intermediate wall to substantially separate and confine air from the first portion of the air flow between the air diverting device and the intermediate wall for discharge only through the first plurality of openings, and to prevent the second portion of the air flow discharging through the first plurality of openings.

10. The temperature-controlled case of claim 9, wherein the upper barrier further defines the plenum, the upper barrier extending substantially between the first portion of the air diverting device and the intermediate wall to prevent the first portion of the air flow from flowing to the second plurality of openings.

11. The temperature-controlled case of claim 10, wherein the first plurality of openings are disposed substantially below the location at which the upper barrier and the intermediate wall converge, and the second plurality of openings are disposed substantially above the location at which the upper barrier and the intermediate wall converge.

12. A temperature-controlled case, comprising:

a rear wall, a front wall, and a deck having a front portion and a rear portion;

an air flow device configured to provide an air flow;

an intermediate wall spaced apart from the rear wall to define a cavity;

at least one shelf including a front portion and a rear portion, the rear portion of the shelf disposed adjacent to the intermediate wall; and at least one air diverting device configured to receive and direct a first portion of the air flow through the cavity and through a first pattern of openings defined by a first size, shape and spacing toward the deck and to permit a second portion of the air flow to be received in the cavity and be directed through a second pattern of openings defined by a second size, shape and spacing toward the shelf;

wherein at least one of the first size, shape and spacing of the first pattern of openings is different from at least one of the second size, shape and spacing of the second pattern or openings;

wherein the first pattern of openings includes an upper row of openings configured to direct a first sub-portion of the first portion of the air flow toward the rear portion of the deck and a lower row of openings configured to direct a second sub-portion of the first portion of the air flow toward the front portion of the deck.

13. The temperature-controlled case of claim 12, wherein the intermediate wall comprises a first set of openings disposed substantially below a second set of openings, and wherein the rear portion of the deck is disposed adjacent to the intermediate wall proximate the first set of openings, and the rear portion of the shelf is disposed adjacent to the intermediate wall proximate the second set of openings.

14. The temperature-controlled case of claim 13, wherein the air diverting device directs the first portion of the air flow through the first set of openings towards the deck and permits the second portion of the air flow to flow through the second set of openings toward the at least one shelf.

15. The temperature-controlled case of claim 12, wherein the first portion of the air flow flows substantially in front of the air diverting device and the second portion of the air flow flows substantially rearward of the air diverting device.

16. The temperature-controlled case of claim 12, wherein the air diverting device at least partially defines a plenum at least partially enclosing the first set of openings and thereby at least partially preventing the second portion of the air flow from flowing through the first set of openings.

17. The temperature-controlled case of claim 16, wherein a first portion of the air diverting device is at least partially disposed within the cavity substantially parallel to intermediate wall.

18. A temperature-controlled case, comprising:

a front wall, a rear wall, and a deck, the deck extending at least partially between the front wall and the rear wall;

an air flow device disposed beneath the deck and configured to provide an air flow;

an intermediate wall spaced apart from the rear wall to define a cavity, the intermediate wall including a first plurality of openings defining a first pattern having a first size, shape and spacing, and a second plurality of openings having a second size, shape and spacing, the first pattern being different from the second pattern;

at least one shelf including a front portion and a rear portion, the rear portion of the shelf disposed adjacent to the intermediate wall; and at least one air diverting device configured to receive and direct a first portion of the air flow away from the second plurality of openings and through the first plurality of openings toward the deck and configured to permit a second portion of the air flow to be directed away from the first plurality of openings and through the second plurality of openings toward the shelf;

wherein the first pattern of openings includes an upper row of openings configured to direct a first sub-portion of the first portion of the air flow toward a rear portion of the deck and a lower row of openings configured to direct a second sub-portion of the first portion of the air flow toward a front portion of the deck.

19. The temperature-controlled case of claim 18, wherein the first portion of the air flow is directed only through the first plurality of openings having the first pattern and the second portion of the air flow is directed only through the second plurality of openings in the intermediate wall having the different second pattern.

* * * * *